US007672622B2

(12) United States Patent
Tsuji et al.

(10) Patent No.: US 7,672,622 B2
(45) Date of Patent: Mar. 2, 2010

(54) SUPPORT ELEMENT, TONER REPLENISHING DEVICE, TONER SUPPLY APPARATUS, AND IMAGE FORMING APPARATUS

(75) Inventors: Akiko Tsuji, Kameyama (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 201 days.

(21) Appl. No.: 11/708,586

(22) Filed: Feb. 21, 2007

(65) Prior Publication Data

US 2007/0217827 A1 Sep. 20, 2007

(30) Foreign Application Priority Data

Mar. 20, 2006 (JP) ..... 2006-77796

(51) Int. Cl.
*G03G 15/08* (2006.01)

(52) U.S. Cl. ..... 399/258

(58) Field of Classification Search ..... 399/258, 399/119, 256, 263
See application file for complete search history.

(56) References Cited

U.S. PATENT DOCUMENTS 5,682,584 A 10/1997 Hattori et al.
7,209,687 B2 * 4/2007 Sudo et al. ..... 399/260
2003/0142998 A1 * 7/2003 Tanaka ..... 399/258
2005/0013633 A1 * 1/2005 Harumoto ..... 399/258
2005/0249533 A1 * 11/2005 Suda et al.
2006/0188273 A1 * 8/2006 Takesawa et al. ..... 399/27
2008/0240813 A1 * 10/2008 Hoshino

FOREIGN PATENT DOCUMENTS

JP 4-40487 2/1992
JP 2005-283631 10/2005

* cited by examiner

*Primary Examiner*—David M Gray
*Assistant Examiner*—Laura K Roth
(74) *Attorney, Agent, or Firm*—Nixon & Venderhye P.C.

(57) ABSTRACT

A support element for supporting a coil spring that rotates to transport toner, and transmitting a rotational force of driving means to the coil spring. The support element includes: an end inserting member with a recess in which an end portion of the coil spring is inserted; a first support member, a second support member with a projection, a third support member, and a fourth support member, which support non-end portions of a first coil spring; and joint members for joining the end inserting member and the support members. This realizes a coil spring support element with which the flow rate of toner from a toner bottle can be increased, and the rotational force of driving means such as a motor can be efficiently transmitted to the coil spring.

35 Claims, 14 Drawing Sheets

SUPPORT ELEMENT, TONER REPLENISHING DEVICE, TONER SUPPLY APPARATUS, AND IMAGE FORMING APPARATUS

This Nonprovisional application claims priority under 35 U.S.C. § 119(a) on Patent Application No. 077796/2006 filed in Japan on Mar. 20, 2006, the entire contents of which are hereby incorporated by reference.

TECHNICAL FIELD

The technical field relates to a support element for supporting and rotating a coil spring used to transport toner, a toner replenishing device equipped with a coil spring supported by the support element, a toner supply apparatus equipped with the toner replenishing device, and an image forming apparatus equipped with the toner supply apparatus.

BACKGROUND

Conventionally, image forming apparatuses of an electrophotographic type, such as copying machines, printers, and facsimiles have been known. The image forming apparatus operates to form an electrostatic latent image on a surface of a photoreceptor and develop the electrostatic latent image with toner. The resulting toner image is transferred and fixed on a printing medium such as a sheet of paper. The toner used for the development of the electrostatic latent image is supplied to the photoreceptor surface from a developing unit. The toner in the developing unit is supplied from a toner bottle via a toner replenishing device and an eject pipe. That is, the toner is transported through a toner transport path, from the toner bottle to the developing unit.

A remaining toner on a photoreceptor drum also needs to be transported.

As methods of transporting toner, techniques using coil springs are disclosed in Patent Publication 1 (Japanese Laid-Open Patent Publication No. 40487/1992 (published on Feb. 10, 1992)), Patent Publication 2 (Japanese Laid-Open Patent Publication No. 2005-283631 (published on Oct. 13, 2005)), and Patent Publication 3 (Japanese Laid-Open Patent Publication No. 44172/1996 (published on Feb. 16, 1996)). Use of coil springs requires driving means, such as a motor, for rotating the coil springs.

In the techniques described in Patent Publications 2 and 3, a rotational axis member is provided in the entire space (hollow space) inside the coil spring, and the coil spring is rotated by the rotation of the rotational axis member. In Patent Publication 1, a rotational axis member is provided inside the coil spring, a predetermined distance away from an end of the coil spring.

In an arrangement where the toner bottle is disposed above the developing unit, the toner bottle and the developing unit are generally disposed in this order from above, with the toner replenishing device and the eject pipe placed in between, as shown in FIG. 18. In such case, a layout of these members looks like a square with an open side, as shown in FIG. 18, taking into consideration the layout of other components in the image forming apparatus. Here, a toner inlet leading from the toner bottle, and a toner outlet leading to the eject pipe are formed on one end of the toner replenishing device. A motor for rotating a coil spring is also disposed on this side of the device, in the case where the toner replenishing device uses a coil spring.

FIG. 19 shows an exemplary structure of a toner replenishing device in which the toner inlet, the toner outlet, and the motor are disposed on the same end of the device. FIG. 19 is an upper view of a toner replenishing device 1000.

As shown in FIG. 19, the toner replenishing device 1000 includes a cabinet 1001, two coil springs 1002 and 1003, rotational axis members 1004 and 1005 for supporting and rotating the coil springs 1002 and 1003, respectively, and a motor.

The cabinet 1001 is narrow and rectangular in shape, and an upper surface of the cabinet 1001 is detachable to store the coil springs 1002 and 1003 therein. In FIG. 19, the upper surface of the cabinet 1001 is not shown. At one end in the lengthwise direction of the cabinet 1001, the upper surface and bottom surface of the cabinet 1001 are respectively provided with a toner inlet 1006 leading from the toner bottle, and a toner outlet 1007 leading to the eject pipe.

The cabinet 1001 has a partition 1008 that extends along a lengthwise direction. The partition 1008 divides the cabinet 1001 into coil spring storing spaces 1009 and 1010 for respectively storing the coil springs 1002 and 1003. The coil spring storing space 1009 is sized so that the coil spring 1002 can be stored and rotated therein. The same is the case for the coil spring storing space 1010. The coil springs 1002 and 1003 are disposed in the coil spring storing spaces 1009 and 1010, respectively.

On the opposite end of the toner inlet 1006 and the toner outlet 1007 in the lengthwise direction of the cabinet 1001, the partition 1008 is provided with a bypass portion 1011 through which the coil spring storing spaces 1009 and 1010 communicate with each other.

With this structure, the toner that has flown into the coil spring storing space 1010 through the toner inlet 1006 moves to the bypass portion 1011 (in a direction of arrow G in FIG. 19) by the rotation of the coil spring 1003. Through the bypass portion 1011, the toner is transported to the coil spring storing space 1009. By the rotation of the coil spring 1002, the toner is transported to the toner outlet 1007 (in a direction of arrow H in FIG. 19). In this manner, the toner is agitated as it moves along the coil spring storing spaces 1009 and 1010, and is uniformly ejected to the developing unit.

When a rotational axis member is used to transmit the rotational force of the motor to the coil spring 1003, the rotational axis member has conventionally been mounted at an end of the coil spring 1003 on the side closer to the motor. However, as described above, the motor for rotating the coil spring 1003 is disposed at an end where the toner inlet 1006 is provided, as shown in FIG. 19. As a result, the rotational axis member occupies inside the coil spring 1003, directly below the toner inlet 1006.

FIG. 20(*a*) is a longitudinal section at end portions of the coil spring 1003 and the rotational axis member 1005, taken along a plane parallel to the rotational axis. FIG. 20(*b*) is a cross section of the coil spring 1003 and the rotational axis member 1005, taken along a plane perpendicular to the rotational axis. As shown in FIGS. 20(*a*) and 20(*b*), the rotational axis member 1005 occupies the space (hollow space) inside the coil spring 1003. Because the rotational axis member 1005 resides directly below the toner inlet, the toner from the toner bottle is not supplied smoothly.

One way to create more space below the toner inlet 1006 is to provide a transmitting member of the motor rotational force only at a terminus of the coil spring 1003. However, this is disadvantageous in terms of manufacture, because it requires welding or other processes to firmly join the transmitting member and the coil spring. Another drawback is that the force of the motor concentrates on the terminus of the coil spring and causes a fatigue in this portion of the coil spring, with the result that the coil spring is easily broken. Further, there is a problem of material recycling. That is, it requires labor to separately collect the coil spring, made of metal, and the transmitting member, made of resin, when the device is scrapped for disposal.

SUMMARY

An object of one or more embodiments of the invention is to provide a coil spring support member, with which the flow rate of toner from a toner bottle can be increased, and the rotational force of driving means such as a motor can be efficiently transmitted to the coil spring.

In order to achieve the foregoing object, in an embodiment, a support element is provided for supporting a coil spring that rotates to transport toner, and transmitting a rotational force of driving means to the coil spring, the support element including: an end inserting member with a recess in which an end portion of the coil spring is inserted; a plurality of support members for supporting non-end portions of the coil spring; and a joint member for joining the end inserting member and the support members.

According to this structure, the support element supports an end portion and non-end portions of the coil spring.

For example, the support members include: a first support member for supporting the coil spring at a position ¼ of a coil from the end portion of the coil spring; a second support member for supporting the coil spring at a position ½ of a coil from the end portion of the coil spring; and a third support member for supporting the coil spring at a position 3/2 coils from the end portion of the coil spring.

The joint member joins the end inserting member and the support members. This sets relative positions of the end inserting member and the support members.

The joint member is only required to join the end inserting member and the support members. As such, the joint members are structured to solely serve this purpose.

The foregoing construction creates a free space inside the coil spring where toner can enter. This was not possible with a conventional structure in which a rotational axis member occupied inside the coil spring. With the forgoing construction, the support element does not block a toner flow, even though the toner inlet is formed above the support element. This increases the toner flow rate as compared with the conventional structure.

Further, since the support element supports the coil spring at more than one position including an end portion, the rotational force of the driving means such as a motor can be efficiently transmitted to the coil spring.

Additional objects, features, and strengths of the embodiment(s) of the present invention will be made clear by the description below. Further, the advantages of the embodiment (s) will be evident from the following explanation in reference to the drawings.

BRIEF DESCRIPTION OF THE DRAWINGS

FIG. 6(*b*) is a cross sectional view of a coil spring installed in the toner replenishing device.

FIG. 20(*b*) is a cross sectional view of a conventional rotational axis member and an end portion of a coil spring, taken along a plane perpendicular to the rotational axis.

DESCRIPTION OF THE EMBODIMENTS (Structure of Image Forming Apparatus)

The following will describe one embodiment of the present invention with reference to the attached drawings.

Figure 2:
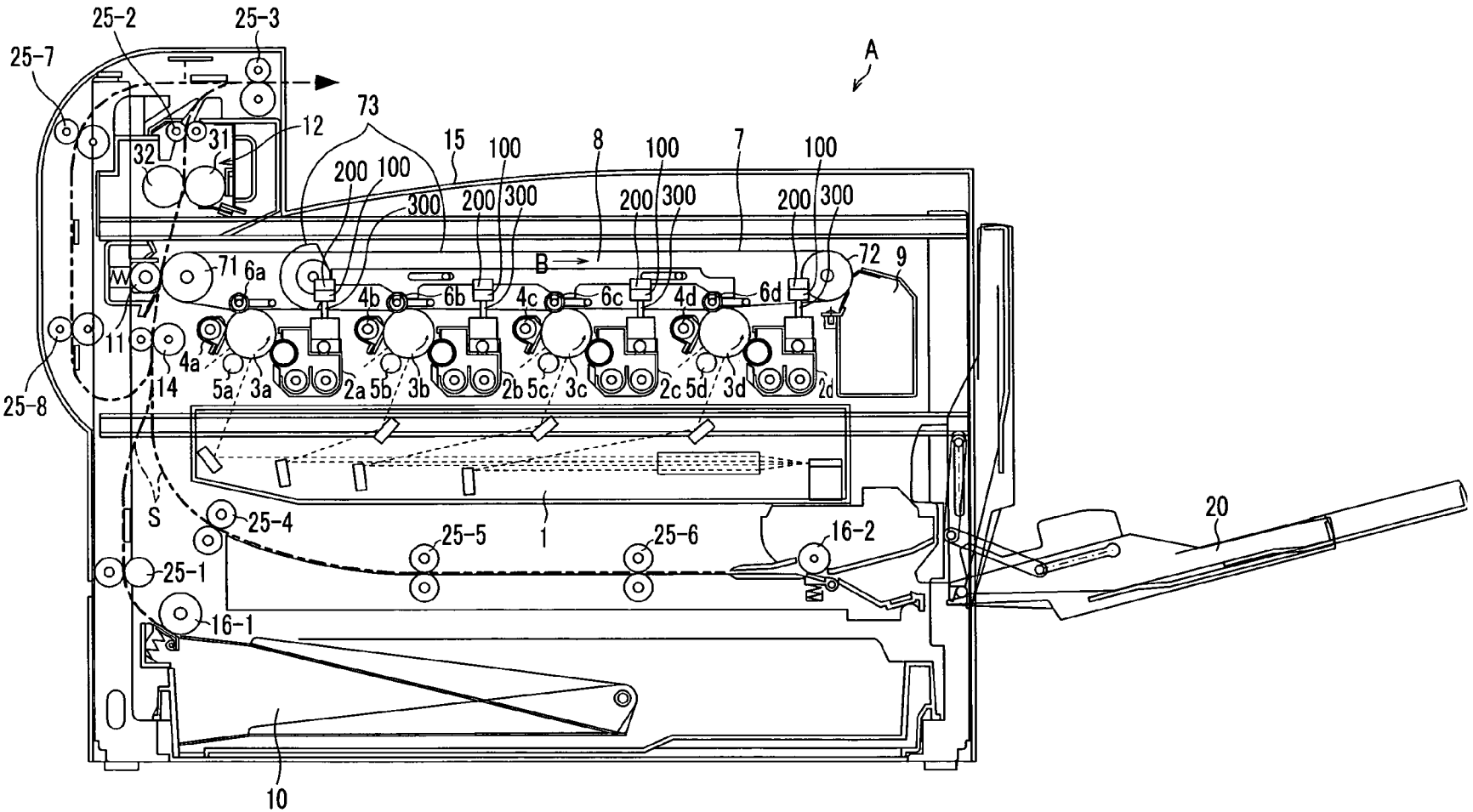
FIG. 2 is a cross sectional view of an image forming apparatus according to one embodiment of the present invention.

FIG. 2 is an explanatory drawing showing a structure of an image forming apparatus A according to an embodiment of the present invention. The image forming apparatus A operates to form a multi-color or monochromatic image on a sheet (printing medium) based on image data which has been supplied either externally or by being read out from a document.

As shown in FIG. 2, the image forming apparatus A includes an exposure unit 1, developing units 2, photoreceptor drums 3, chargers 5, cleaner units 4, an intermediate transfer belt 8, a fixing unit 12, a sheet transport path S, a feed tray 10, and an eject tray 15, among other components.

Color image data processed by the image forming apparatus A corresponds to color images of black (K), cyan (C), magenta (M), and yellow (Y). As such, four units of developing units 2 (2*a*, 2*b*, 2*c*, 2*d*), photoreceptor drums 3 (3*a*, 3*b*, 3*c*, 3*d*), chargers 5 (5*a*, 5*b*, 5*c*, 5*d*), and cleaner units 4 (4*a*, 4*b*, 4*c*, 4*d*) are provided to form four kinds of latent images, respectively corresponding to the colors of K, C, M, Y. Here, signs a, b, c, d correspond to black, cyan, magenta, and yellow, respectively, and the components of the same colors combine to form four image stations.

In each image station, the photoreceptor drum 3 is disposed in an upper part of the image forming apparatus A. The charger 5 is provided to uniformly charge the surface of the photoreceptor drum 3 at a predetermined potential. In FIG. 2, the charger 5 is realized by a roller of a contact type. Alternatively, the charger 5 may be a contact-type brush, or of an electrostatic charging type.

In FIG. 2, the exposure unit 1 is realized by a laser scanning unit (LSU) equipped with a laser projector and reflecting mirrors. Alternatively, the exposure unit 1 may be realized, for example, by an EL or LED writing head in which light emitting elements are disposed in an array. The exposure unit 1 exposes the charged surface of the photoreceptor drum 3 according to input image data. As a result, an electrostatic latent image that corresponds to the image data is formed on the surface of the photoreceptor drum 3.

The developing unit 2 forms a toner image by visualizing electrostatic latent images of K, C, M, Y formed on the photoreceptor drums 3. After development and image transfer, the cleaner units 4 remove and collect toner remaining on the surfaces of the photoreceptor drums 3.

The intermediate transfer belt unit 8 is provided above the photoreceptor drums 3. The intermediate transfer belt unit 8 includes intermediate transfer rollers 6 (6*a*, 6*b*, 6*c*, 6*d*), an intermediate transfer belt 7, an intermediate transfer belt driving roller 71, an intermediate transfer belt driven roller 72, an intermediate transfer belt tensioner 73, and an intermediate transfer belt cleaning unit 9.

The intermediate transfer belt 7 is suspended by the mechanism including the intermediate transfer rollers 6, the intermediate transfer belt driving roller 71, the intermediate transfer belt driven roller 72, and the intermediate transfer belt tensioner 73. These members drive the intermediate transfer belt 7 to rotate in a direction of arrow B.

The intermediate transfer rollers 6 are rotably supported on intermediate transfer roller mounts, which are provided in the intermediate transfer belt tensioner 73 of the intermediate transfer belt unit 8. The intermediate transfer rollers 6 apply a transfer bias needed to transfer a toner image of the photoreceptor drum 3 onto the intermediate transfer belt 7.

The intermediate transfer belt 7 is provided in contact with the photoreceptor drums 3. Toner images of respective colors formed on the photoreceptor drums 3 are transferred one after another and overlaid on the intermediate transfer belt 7 to form a color toner image (multi-color toner image). The intermediate transfer belt 7 is an endless film with a thickness of 100 μm to 150 μm.

The transfer of toner images from the photoreceptor drums 3 to the intermediate transfer belt 7 is performed by the intermediate transfer rollers 6 in contact with the rear side of the intermediate transfer belt 7. The intermediate transfer rollers 6 have a high-voltage transfer bias (a high voltage of the opposite polarity (+) to the polarity (−) of the charged toner) that has been applied to transfer the toner images. The intermediate transfer rollers 6 are each made out of a metal rod (for example, stainless steel), 8 mm to 10 mm in diameter, coated with a conductive elastic material (for example, such as EPDM, or urethane foam). The conductive elastic material allows the intermediate transfer rollers 6 to uniformly apply a high voltage to the intermediate transfer belt 7. In the present embodiment, the transfer electrodes are realized by rollers (intermediate transfer rollers 6). Alternatively, the transfer electrodes may be realized by brushes or the like.

The electrostatic latent image formed on each photoreceptor drum 3 is visualized into a toner image of a corresponding hue. The toner images are then overlaid on the intermediate transfer belt 7. By the rotation of the intermediate transfer belt 7, the overlaid toner images are moved to a position where the intermediate transfer belt 7 comes into contact with a supplied sheet. The toner images are then transferred onto the sheet by a transfer roller 11 disposed at this position. Here, the intermediate transfer belt 7 and the transfer roller 11 are pressed against each other with a predetermined nip. The transfer roller 11 has a voltage that has been applied to transfer the toner images onto a sheet. The applied high voltage is of the opposite polarity (+) to the polarity (−) of the charged toner.

In order to maintain a constant nip, one of the transfer roller 11 and the intermediate transfer belt driving roller 71 is made of a hard material such as metal, while a soft material (elastic roller such as an elastic rubber roller or an expandable resin roller) is used for the other.

The intermediate transfer belt cleaning unit 9 removes and collects toner that has adhered to the intermediate transfer belt 7 from the photoreceptor drums 3 in contact with the intermediate transfer belt 7, and toner remaining on the intermediate transfer belt 7 without having been transferred to a sheet during the transfer of the toner images. This is to prevent these toners from causing mixing of colors in the subsequent steps. The intermediate transfer belt cleaning unit 9 includes a cleaning member, for example, such as a cleaning blade, in contact with the intermediate transfer belt 7. The intermediate transfer belt 7 in a portion in contact with the cleaning blade is supported from the rear side by the intermediate transfer belt driven roller 72.

The feed tray 10 is provided to store sheets (e.g., printing medium) used to form image, and it is disposed below an image forming section and the exposure unit 1. The eject tray 15, disposed in an upper part of the image forming apparatus A, is used to place printed sheets facedown.

In the image forming apparatus A, the sheet transport path S is provided to transport a sheet on the feed tray 10 or a manual feed tray 20 to the eject tray 15 via the transfer roller 11 and the fixing unit 12. The sheet transport path S in a region stretching from the feed tray 10 to the eject tray 15 includes; pickup rollers 16; a registration roller 14; a transfer section provided with the transfer roller 11; the fixing unit 12; and transport rollers 25, among other components.

The transport rollers 25 are small rollers, provided along the sheet transport path S, that facilitate and assist transport of sheets. The pickup roller 16 is provided at one end of the feed tray 10, and it supplies a sheet, one at a time, to the sheet transport path S by drawing a sheet from the feed tray 10. The registration roller 14 holds a sheet as it travels through the sheet transport path S, and sends it to the transfer section at such a timing that the front end of the toner image formed on the photoreceptor drum 3 meets that front end of the sheet.

The fixing unit 12 includes a heat roller 31 and a press roller 32, among other components. The heat roller 31 and the press roller 32 rotate with a sheet in between. The heat roller 31 is controlled by a control section (not shown) at a predetermined fixing temperature. The control section controls the heat roller 31 based on a detected signal from a temperature detector (not shown). The heat roller 31 heat-presses a sheet with the press roller 32, so as to fuse, mix, and press the transferred toner images of the respective colors onto the sheet, i.e., the toner images are heat-fixed onto the sheet. The sheet with the fixed multi-color toner images (toner images of the respective colors) is transported by the transport rollers 25 to a reverse ejection path of the sheet transport path S. The sheet, by being reversed, is ejected onto the eject tray 15 (with the multi-color toner images facing down).

The following will describe a sheet transport operation in the sheet transport path S, in conjunction with processes performed by other components. As described above, the feed tray (feed cassette) 10 and the manual feed tray 20 are among the components of the image forming apparatus A. The feed tray (feed cassette) 10 is used to store sheets, and the manual feed tray 20 is used when making only a small number of prints. The feed tray 10 and the manual feed tray 20 are respectively provided with the pickup rollers 16 (16-1, 16-2), which supply a sheet, one at a time, to the sheet transport path S.

(Single-Sided Printing)

A sheet supplied from the feed cassette 10 is transported to the registration roller 14 by the transport roller 25-1 provided in the sheet transport path S. The registration roller 14 sends the sheet to the transfer section at such a timing that the front end of the sheet meets the front end of the overlaid toner images on the intermediate transfer belt 7. At the transfer section, the toner images are transferred onto the sheet and fixed thereon by the fixing unit 12. The sheet is then transported by the transport roller 25-2 and ejected onto the eject tray 15 by the eject roller 25-3.

A sheet supplied from the manual feed tray 20 is transported to the registration roller 14 by the transport rollers 25 (25-6, 25-5, 25-4). The sheet is then ejected onto the eject tray 15 by traveling through the same passage as the sheet supplied from the feed cassette 10.

(Double-Sided Printing)

A sheet that has been finished with single-sided printing and passed through the fixing unit 12 is chucked by the discharge roller 25-3 on the rear end of the sheet. By the reverse rotation of the transport roller 25-3, the sheet is guided to the transport rollers 25-7 and 25-8. Then, the sheet is ejected to the eject tray 15 after the rear side of the sheet has been printed.

(Structure of Toner Replenishing Unit)

As shown in FIG. 2, eject pipes 300 are provided above the developing units 2, and a toner replenishing device 100 and a toner bottle 200 are provided above each eject pipe 300. The developing unit 2 and the toner bottle 200 are in communication with each other via the toner replenishing device 100 and the eject pipe 300, so that the toner contained in the toner bottle 200 is supplied to the developing unit 2 via the toner replenishing device 100 and the eject pipe 300.

The toner bottle 200, the toner replenishing device 100, the eject pipe 300, and the developing unit 2 constitute a toner supply apparatus.

Figure 18:
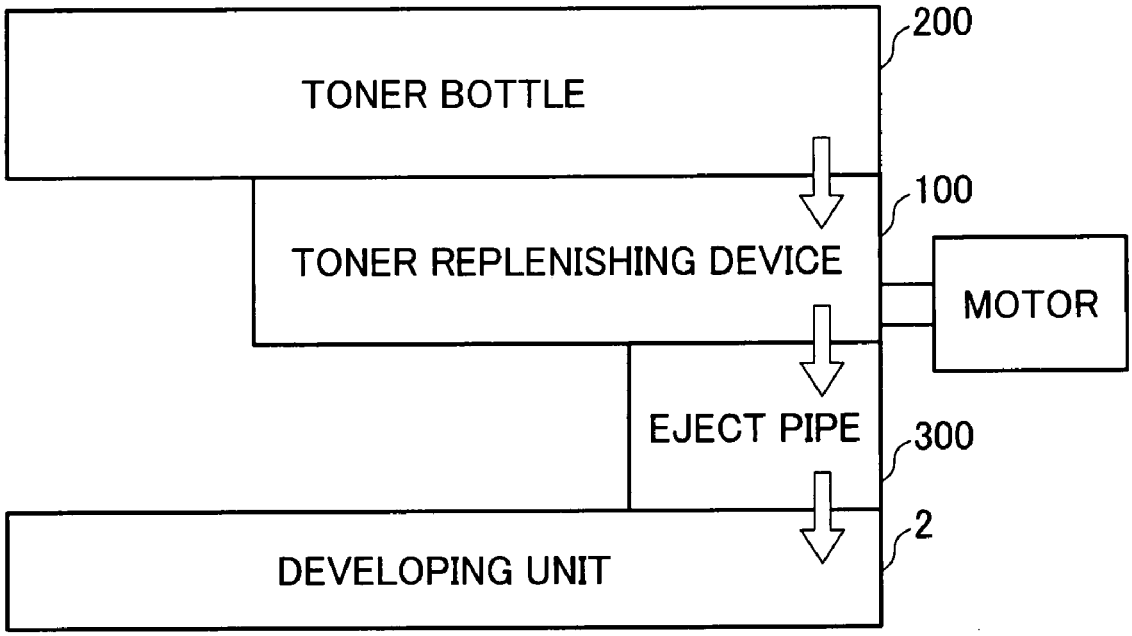
FIG. 18 is a diagram showing a layout of a toner bottle, a toner replenishing device, an eject pipe, and a developing unit.
Figure 19:
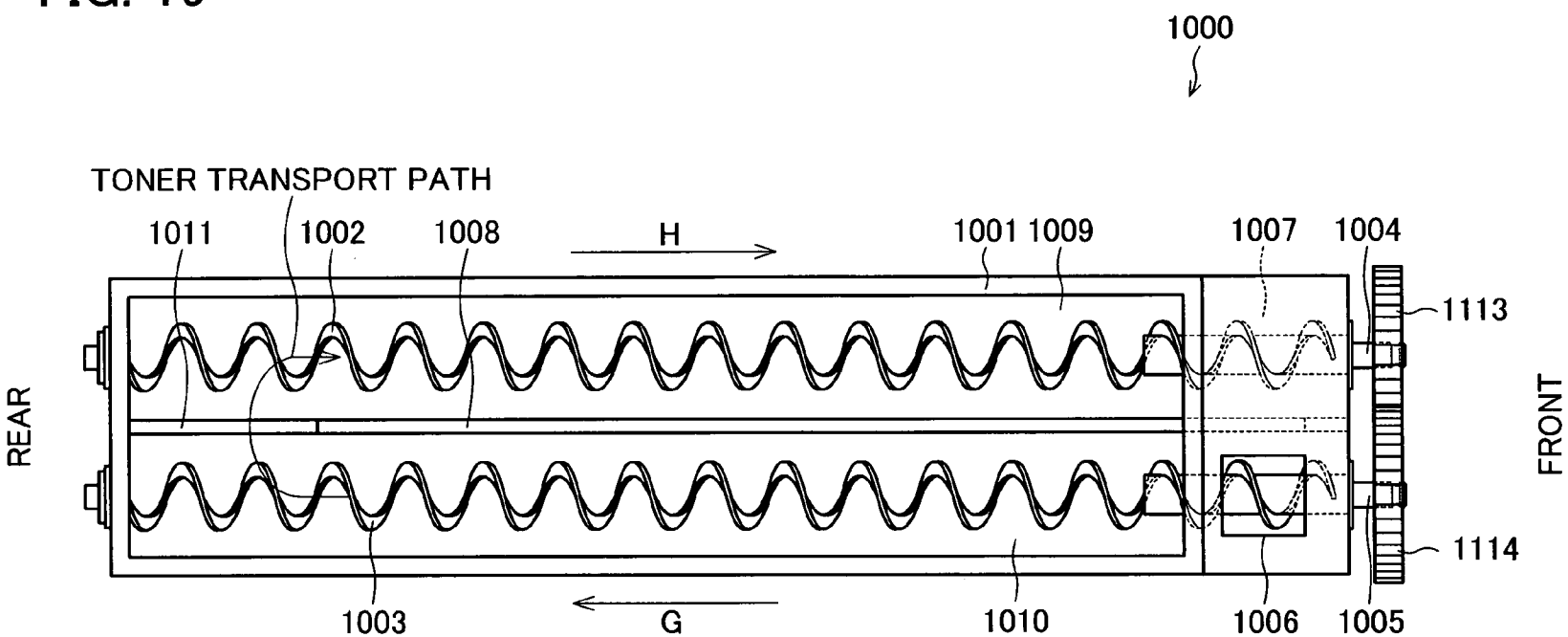
FIG. 19 is an upper view of a toner replenishing device as a comparative example of the present invention.
Figure 20:
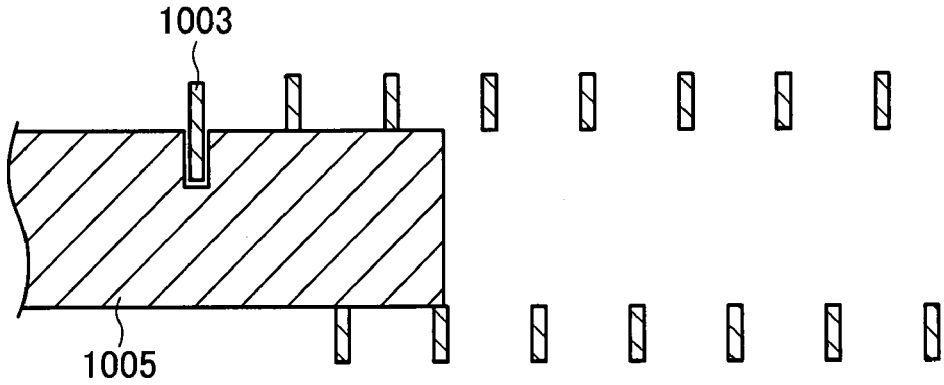
FIG. 20(*a*) is a longitudinal sectional view of a conventional rotational axis member and an end portion of a coil spring, taken along a plane parallel to the rotational axis.
Figure 20:
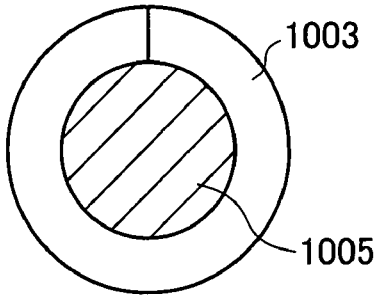

In the present embodiment, the developing unit 2, the eject pipe 300, the toner replenishing device 100, and the toner bottle 200 are structured such that the whole structure looks like a square with an open side, as shown in FIG. 18. Such a configuration is for the movement of the intermediate transfer belt 7 between the toner replenishing device 100 and the developing unit 2, as shown in FIG. 2. Note that, in the present embodiment, the developing unit 2, the eject pipe 300, and the toner bottle 200 can adopt conventional structures and functions.

(Structure of Toner Replenishing Device)

Figure 3:
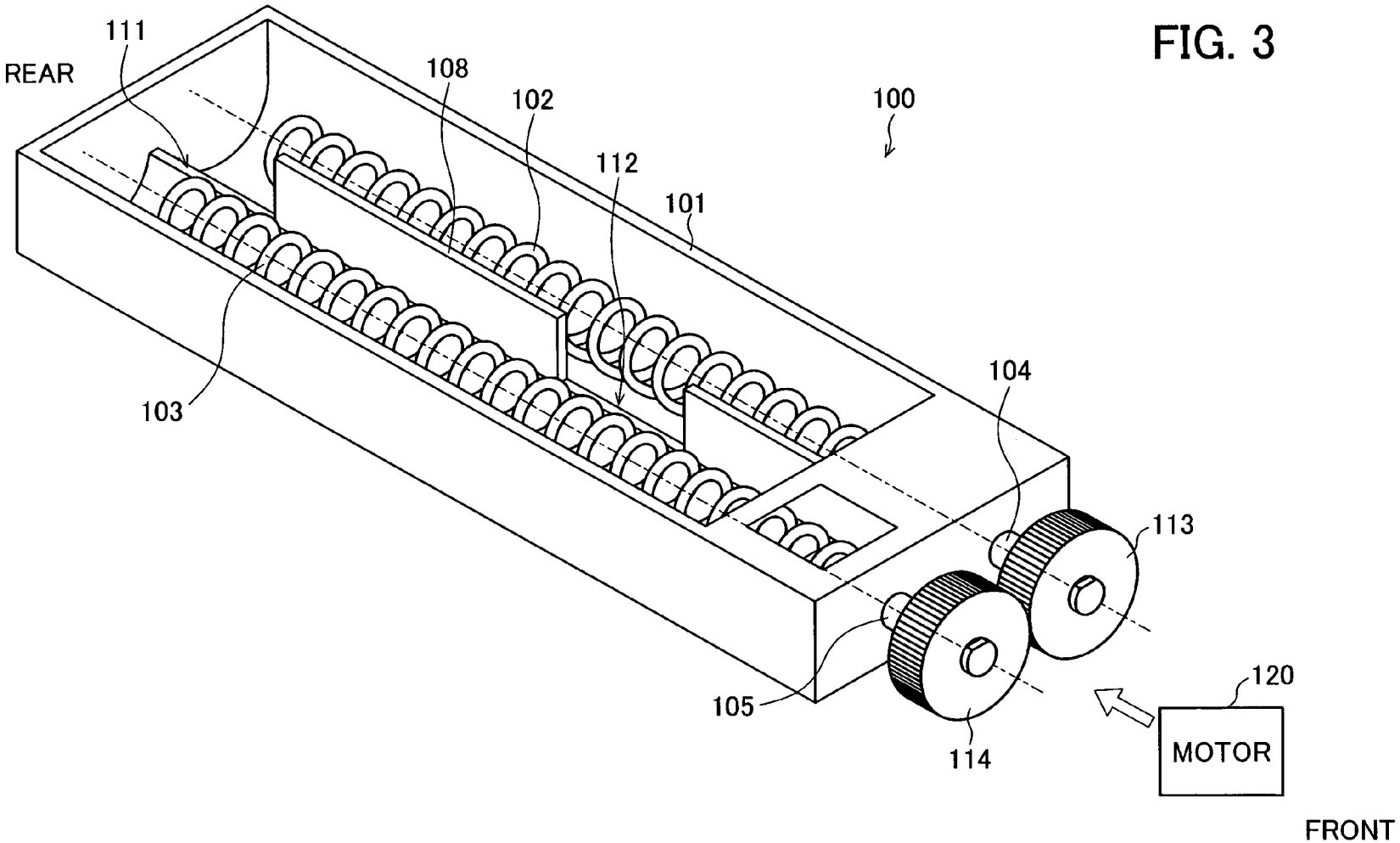
FIG. 3 is a perspective view of a toner replenishing device provided in the image forming apparatus shown in FIG. 2.
Figure 4:
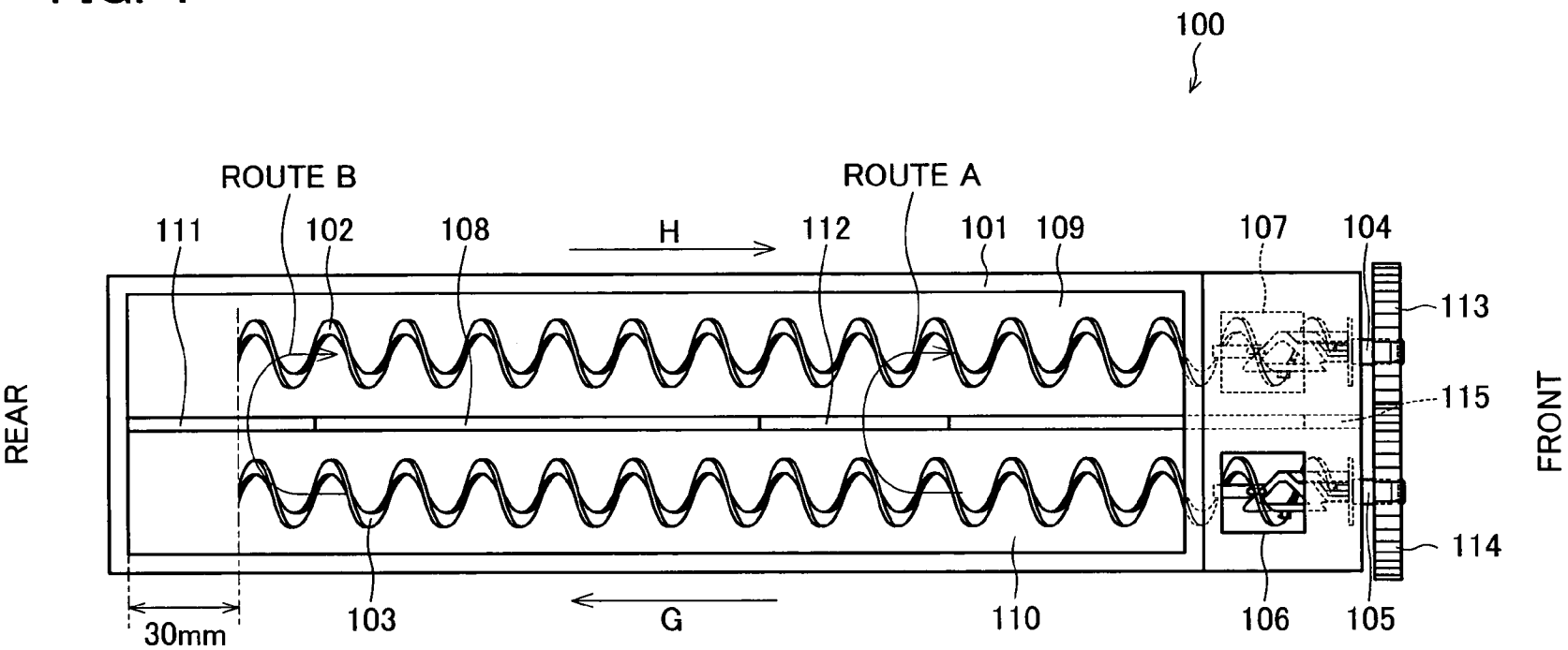
FIG. 4 is an upper view of the toner replenishing device.

FIG. 3 is a perspective view schematically illustrating the toner replenishing device 100. FIG. 4 is a schematic view of the toner replenishing device 100 as viewed from above. The toner replenishing device 100 includes: a cabinet 101, two coil springs 102 and 103, a motor 120, support elements 104 and 105 which supports the coil springs 102 and 103, and rotate the coil springs 102 and 103 by transmitting the generated torque of the motor 120 thereto, and gears 113 and 114 which transmit the torque of the motor 120 to the support elements 104 and 105.

In the following, an end provided with the gears 113 and 114 will be referred to as a front end, and the other end will be referred to as a rear end.

The cabinet 101 is narrow and rectangular in shape, and an upper surface of the cabinet 101 is in contact with a bottom surface of the toner bottle 200. The cabinet 101 houses the coil strings 102 and 103. For this purpose, the upper surface of the cabinet 101 is partially detachable. FIGS. 3 and 4 show the cabinet 101 with a part of the upper surface detached.

The cabinet 101 has a partition 108 that extends along a lengthwise direction. Inside the cabinet 101 is parted into two spaces (first coil spring storing space 110, second coil spring storing space 109) by the partition 108. The first coil spring storing space 110 and the second coil spring storing space 109 are sized so that the coil springs 103 and 102 are stored in the respective spaces with a predetermined clearance (for example, 30 mm) between the rear end of the coil springs 102 and 103 and the inner rear wall of the cabinet 101.

In this manner, the coil springs 103 and 102 are respectively stored in the first coil spring storing space 110 and the second coil spring storing space 109. That is, the coil springs 103 and 102 are stored side by side, with their axes facing each other in parallel.

In the first coil spring storing space 110, the first coil spring 103 rotates to transport toner from the front to rear (in a direction of arrow G in FIG. 4). In the second coil spring storing space 109, the second coil spring 102 rotates to transport toner from the rear to front (in a direction of arrow H in FIG. 4). That is, toner is transported in opposite directions in the first coil spring storing space 110 (direction of arrow G) and the second coil spring storing space 109 (direction of arrow H).

In the case where the toner has blocked the second coil spring storing section 109 and the rotation of the second coil spring 102 is not sufficient to break the toner block, the second coil spring 102 stretches itself in length by the rotation. In the present embodiment, the stretch is absorbed by the clearance on the rear. Because the clearance prevents the rear end of the second coil spring 102 from being restrained against the inner rear walls of the cabinet 101, the second coil spring 102 does not sprung out of the cabinet 101.

In the upper surface of the first coil spring storing space 110 at an upstream end (front end) in the toner transport direction, there is provided a toner inlet 106 through which toner is supplied from the toner bottle 200.

In the bottom surface of the second coil spring storing space 109 at a downstream end (front end) in the toner transport direction, there is provided a toner outlet 107 that is in communication with the eject pipe 300.

Figure 5:
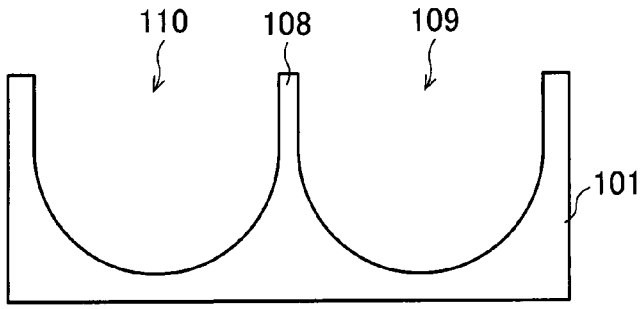
FIG. 5 is a cross sectional view showing a cabinet portion of the toner replenishing device.

FIG. 5 is a cross sectional view of the cabinet 101, taken along a plane perpendicular to the lengthwise direction of the cabinet 101. As shown in FIG. 5, the bottom surfaces of the first and second coil spring storing spaces 110 and 109 are semi-circular in shape, with the same curvature as that of the coil springs 102 and 103.

With this construction, toner will not be caught between the coil springs 102 and 103 and the bottom surfaces of the first and second coil spring storing spaces 110 and 109, allowing the toner to be transported smoothly.

The inner walls of the first and second coil spring storing spaces 110 and 109, and particularly bottom portions where the coil springs 102 and 103 are brought into contact by the force of gravity are embedded with glass beads, which are provided as anti-abrasion material. This is intended to prevent abrasion caused by the rotation of the coil springs 102 and 103 stored in the coil spring storing spaces 109 and 110. As the anti-abrasion material, ceramic beads or metal beads may be used instead of glass beads.

In the present embodiment, the partition 108 is separated from the wall surfaces of the cabinet 101. As a result, a first bypass portion 111 is formed between the partition 108 and the rear end wall surface of the cabinet 101. The first bypass portion 111 allows the first and second coil spring storing spaces 110 and 109 to communicate with each other. Similarly, a third bypass portion 115 is formed between the partition 108 and the front end wall surface of the cabinet 101. The third bypass portion 115 allows the first and second coil spring storing spaces 110 and 109 to communicate with each other. The partition 108 also has a second bypass portion 112 between the first bypass portion 111 and the toner openings (toner inlet 106, toner outlet 107), about ¼ from the front end portion of the cabinet 101 along the lengthwise direction. Through the second bypass portion 112, the first and second coil spring storing spaces 110 and 109 communicate with each other.

With this structure, the toner that has flown into the toner inlet 106 formed on the upper surface of the cabinet 101 enters the first coil spring storing space 110 and is transported by the rotation of the first coil spring 103 in a direction of arrow G, as shown in FIG. 4. Here, some of the toner enters the second coil spring storing space 109 through the second bypass portion 112 (route A), and remaining toner enters the second coil spring storing space 109 through the first bypass portion 111 (route B). In the second coil spring storing space 109, the toner is transported in a direction of arrow H, as shown in FIG. 4, by the rotation of the second coil spring 102 and ejected through the toner outlet 107. Remaining toner that was not ejected from the toner outlet 107 reenters the first coil spring storing space 110 through the third bypass portion 115.

In this manner, in the toner replenishing device 100, some of the toner is transported in route B through the first bypass portion 111, and remaining toner is transported in route A through the second bypass portion 112.

In route B, the distance between the toner inlet 106 and the toner outlet 107 is sufficiently long, allowing the toner to be sufficiently agitated. Route A has a shorter distance between the toner inlet 106 and the toner outlet 107 as compared with route B, allowing the toner to be quickly ejected. The toner traveling in route A meets the sufficiently agitated toner that has traveled route B. Since these toners are mixed together, the problems of toner aggregation, charge, and uniformity do not occur.

(Shape of Coil Spring)

Figure 6:
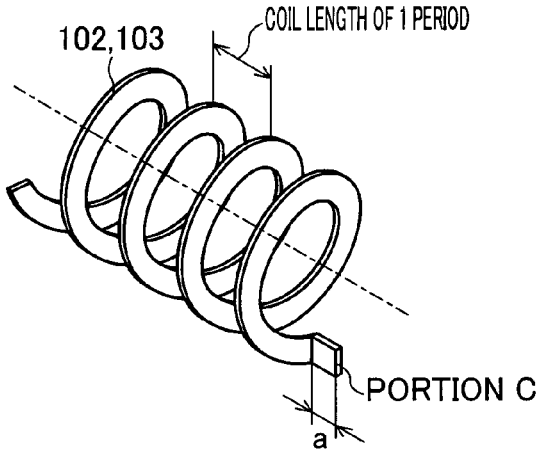
FIG. 6(*a*) is a perspective view of a coil spring installed in the toner replenishing device.
Figure 6:
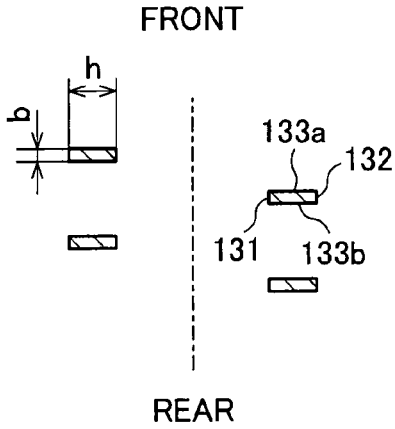

FIGS. 6(*a*) and 6(*b*) are views illustrating coil springs 102 and 103 stored in the toner replenishing device 100, in which FIG. 6(*a*) is a perspective view, and FIG. 6(*b*) is a longitudinal section taken along a plane including the axis.

The coil springs 102 and 103 are coiled clockwise toward an end away from the plane of paper as shown in FIG. 6(*a*). In the following, the length of the coil springs 102 and 103 for n rotations will be referred to as a coil length of n period. FIG. 6(*a*) shows a coil length of one period.

As shown in FIG. 6(*a*), the coil springs 102 and 103 at one end have a portion C of a length a parallel to the axial direction. The portion C is used as a support where the coil springs 102 and 103 are supported by the support elements 104 and 105, as will be described later.

Further, as shown in FIG. 6(*b*), the coil springs 102 and 103 are rectangular in shape in the longitudinal section. Specifically, the longitudinal section of the coil springs 102 and 103 is a rectangle composed of a first side 131 (length b), a second side 132 (length b), and two third sides 133*a* and 133*b* (length h: h>b). The first side 131 is parallel to the axes of the coil springs 102 and 103 and is situated on the inner side of the coil springs 102 and 103. The second side 132 is parallel to the axes of the coil springs 102 and 103 and is situated on the outer side of the coil springs 102 and 103. The third sides 133*a* and 133*b* are perpendicular to the axes of the coil springs 102 and 103. Note that, as described herein, the third side 133*a* and the third side 133*b* are respectively defined as the front side and rear side of the coil springs 102 and 103 stored in the toner replenishing device 100.

Figure 7:
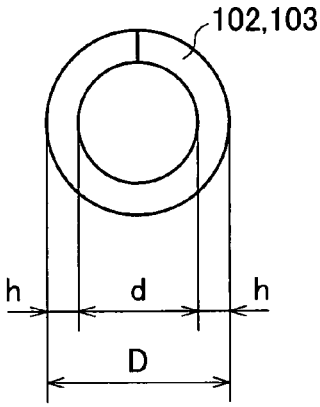
FIG. 7 is a diagram showing a coil spring, as viewed in the axial direction.

As such, in a cross section of the coil springs 102 and 103, a coil outer diameter D is defined as a coil inner diameter d added to (length h×2), as shown in FIG. 7. With this construction, the coil springs 102 and 103 rotate to efficiently transmit the force that propels the toner along the axial direction.

(Structure of Support Element)

In the following, description is made as to the support element 105 that supports a front end of the coil spring 103 stored in the first coil spring storing space 110, and that transmits the rotational force of the motor 120 to the coil spring 103.

The support element 105 is mounted at a front end of the first coil spring 103. The motor 120 for rotating the coil spring 103 is also mounted on the front end as shown in FIGS. 3 and 4, taking into account the position of the intermediate transfer belt 7 in the image forming apparatus A. That is, the support element 105 resides directly below the toner inlet 106.

Figure 8:
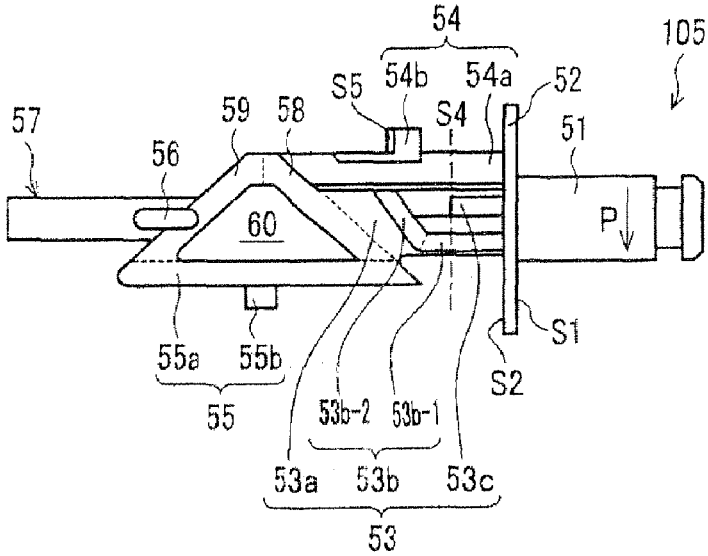
FIG. 8 is a front view of the support element supporting the first coil spring.
Figure 9:
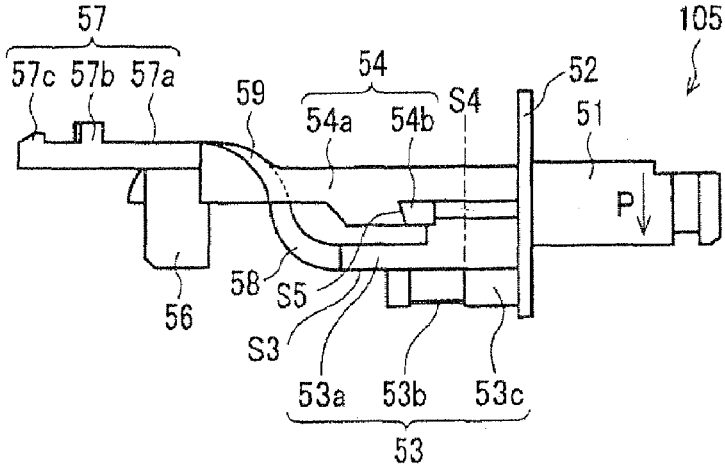
FIG. 9 is a front view showing the support element, when the support element is rotated by 90 degrees in a direction of arrow P, relative to the orientation shown in FIG. 8.
Figure 10:
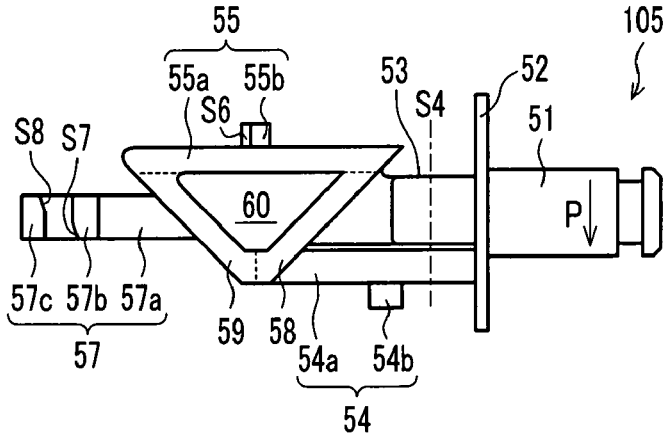
FIG. 10 is a front view showing the support element, when the support element is rotated by 180 degrees in a direction of arrow P, relative to the orientation shown in FIG. 8.
Figure 11:
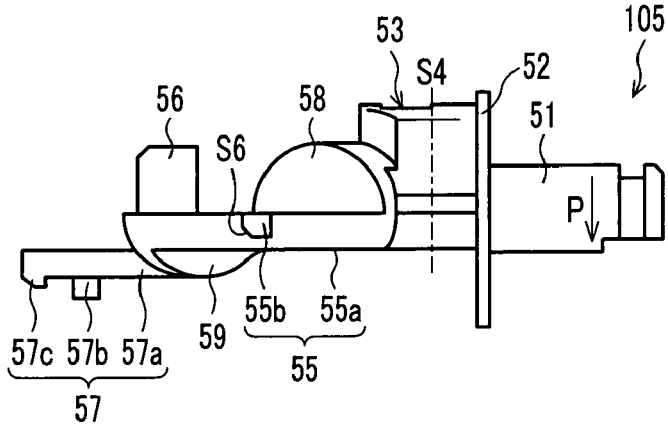
FIG. 11 is a front view showing the support element, when the support element is rotated by 270 degrees in a direction of arrow P, relative to the orientation shown in FIG. 8.
Figure 12:
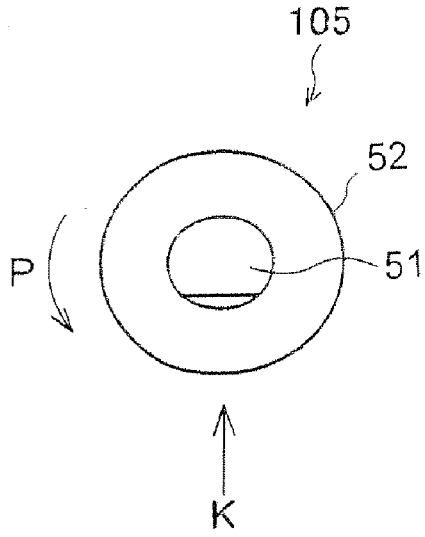
FIG. 12 is a diagram showing how the support element supports the first coil spring upon installation in the toner replenishing device, as viewed from the front.
Figure 13:
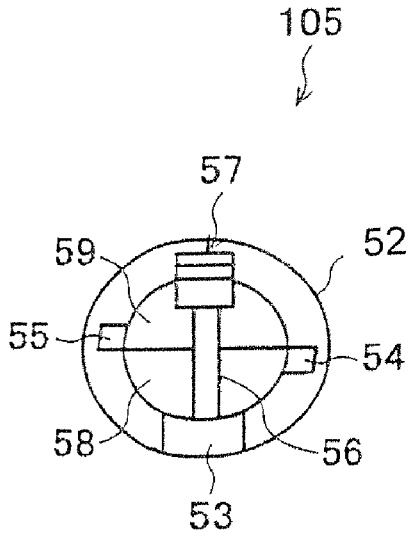
FIG. 13 is a diagram showing how the support element supports the first coil spring upon installation in the toner replenishing device, as viewed from the rear.

FIGS. 8 through 13 are diagrams showing the support element 105 as viewed in six different directions. FIG. 12 shows the support element 105 installed in the toner replenishing device 100, as viewed from the front. FIG. 13 shows the support element 105 as viewed from the rear. FIG. 8 is a plan view of the support element 105 as viewed in a direction of arrow K shown in FIG. 12. FIGS. 9, 10, and 11 are front views of the support element 105 at angular positions of 90, 180, and 270 degrees, respectively, measured in a direction of arrow P shown in FIG. 8 and FIG. 12.

As shown in these figures, the support element 105 is an integral unit including a cylindrical member 51, a disc 52, an end inserting member 53, a first support member 54, a second support member 55, a third support member 57, a fourth support member 56, a first joint member 58, and a second joint member 59.

With this construction, the support element 105 has an opening 60 surrounded by the second support member 55, the first joint member 58, and the second joint member 59. The support element 105 therefore does not occupy the inner space of the coil spring 103 and provides a free space below the toner inlet 106. This increases the flow rate of toner from the toner bottle 200.

The support element 105 is made of hard resin.

The cylindrical member 51 is cylindrical in shape, and has an end connected to the disc 52. The other end of the cylindrical member 51 is partially cut off, as shown in FIGS. 9 and 11. More specifically, as shown by the cross section of FIG. 12, a portion defined by the chord and arc of a circle is cut off. This is shaped to fit the cut-off portion formed on the center of the gear 114 (see FIG. 3) that is in mesh with the gear of the motor 120. With this construction, this end of the cylindrical member 51 engages the center of the gear 114, and the cylindrical member 51 rotates on its axis by the driving force of the motor 120. In sum, the rear end of the cylindrical member 51 is connected to the disc 52, and the front end of the cylindrical member 51 engages the gear 114.

The disc 52 has a surface S1 (front side) in contact with the cylindrical member 51, and a surface S2 (rear side) in contact with the end inserting member 53 and the first support member 54. In other words, the disc 52 joins the cylindrical member 51, the end inserting member 53, and the first support member 54 to set their relative positions. The axis of the disc 52 coincides with the axis of the cylindrical member 51, and as such the disc 52 rotates by the rotation of the cylindrical member 51. The disc 52 has the same diameter as the coil outer diameter D (see FIG. 7) of the coil spring 103.

The end inserting member 53 supports the portion C at the end of the coil spring 103 (see FIG. 6(*a*)), and is defined by a base portion 53*a* and two wall portions 53*b* and 53*c*.

The base portion 53*a* is perpendicular to the disc 52. The base portion 53*a* is structured such that a surface S3 farthest from the axis of the cylindrical member 51 (axis of the disc 52) defines part of a surface of a cylinder whose central axis coincides with the axis of the cylindrical member 51 and whose diameter coincides with or is slightly smaller than the coil inner diameter d of the coil spring 103.

The two wall portions 53*b* and 53*c* are formed on the surface S3 of the base portion 53*a*, perpendicular to the surface S3. The height of the wall portions 53*b* and 53*c* from the surface S3 is the same as the length h of the third sides 133*a* and 133*b* as measured in the longitudinal section of the coil spring 103 (see FIG. 6(*b*)).

The first wall portion 53*b* is kinked, and includes a first region 53*b*-1 perpendicular to the disc 52, and a second region 53*b*-2 slanted relative to the disc 52. The first region 53*b*-1 is connected to the disc 52.

The second wall portion 53*c* is formed parallel to the first region 53*b*-1 of the first wall portion 53*b*. The height of the second wall portion 53*c* relative to the surface S2 of the disc 52 is the same as the length a of the portion C formed at an end of the coil spring 103, the portion C being a region parallel to the axis of the coil spring 103.

The distance between the first wall portion 53*b* and the second wall portion 53*c* is slightly greater than the length b of the first and second sides 131 and 132 of the coil spring 103 as measured in the longitudinal section of the coil spring 103. This enables the portion C of the coil spring 103 to be inserted between the first wall portion 53*b* and the second wall portion 53*c*. That is, the first wall portion 53*b*, the second wall portion 53*c*, and the base portion 53*a* define a recess (cross section) where the portion C at an end of the coil spring 103 is inserted.

Figure 1:
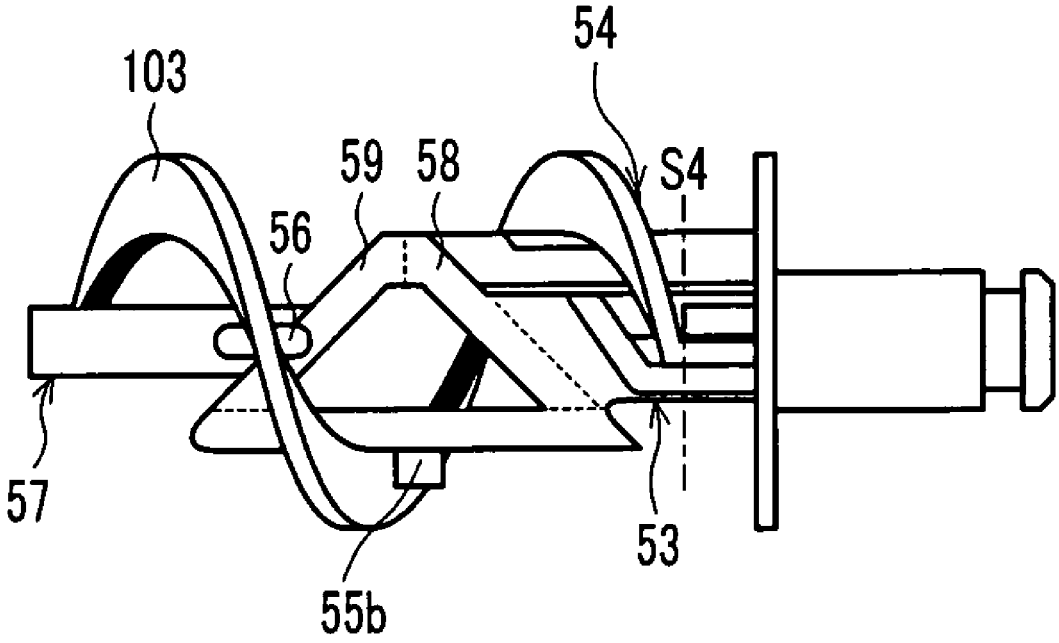
FIG. 1 is a front view showing a support element supporting a coil spring, according to one embodiment of the present invention.

FIG. 1 shows how the support element 105 shown in FIG. 8 is mounted on the coil spring 103. As shown in FIG. 1, the end inserting member 53 supports an end of the coil spring 103.

The base portion 53*a* is in contact with the first side 131 in the longitudinal section of the coil spring 103. The surface S3 of the base portion 53*a*, in contact with the first side 131, is separated from the axis of the cylindrical member 51 (axis of the disc 52) by the distance equal to or slightly smaller than half the inner diameter d of the coil spring 103. In this way, the axis of the coil spring 103 coincides with the axis of the cylindrical member 51, and thereby enables the rotational force of the motor 120 to be efficiently transmitted to the coil spring 103.

Further, as shown in the figures, the coil spring 103 is parallel to the axial direction in a portion inserted between the first wall portion 53*b* and the second wall portion 53*c*. The other portion of the coil spring 103 is helical. In the following, the beginning of the helical part of the coil spring 103 attached to the support element 105 will be referred to as a helix beginning surface S4. This includes a surface of the second wall portion 53*c* farthest from the disc 52, and a surface parallel to the disc 52.

Note that, as shown in FIG. 1, the second region 53*b*-2 of the first wall portion 53*b* is slanted relative to the disc 52, according to the helical shape of the coil spring 103.

The first support member 54 is one of the support members of the coil spring 103, and it includes a long rod member 54*a* and a projection 54*b*.

The rod member 54*a* is parallel to the axis of the cylindrical member 51 (axis of the disc 52), i.e., perpendicular to the disc 52. The rod member 54*a* is separated from the axis of the cylindrical member 51 by the distance equal to, or slightly greater than, half the inner diameter d of the coil spring 103. The rod member 54*a* is at an angular position of about 90 degrees relative to the end inserting member 53, measured in the reverse direction of arrow P shown in FIGS. 8 through 12 about the axis of the cylindrical member 51. One end of the rod member 54*a* is connected to the disc 52, and the other end of the rod member 54*a* is connected to the first joint member 58. The height of the rod member 54*a* is greater than the height of the end inserting member 53, relative to the surface S2 on the rear side of the disc 52.

The projection 54*b* is formed on the rod member 54*a*, at a position away from the helix beginning surface S4 by the distance of a ¼ period coil length of the coil spring 103. The projection 54*b* projects out of the rod member 54*a*, away from the axis of the cylindrical member 51. The projection 54*b* is brought into contact with the coil spring 103 at a position ¼ of a coil from the terminus of the coil spring 103, when the portion C of the coil spring 103 is inserted into the end inserting member 53. In this way, the projection 54*b* serves as a position registration member as well as a support member for the coil spring 103.

Figure 14:
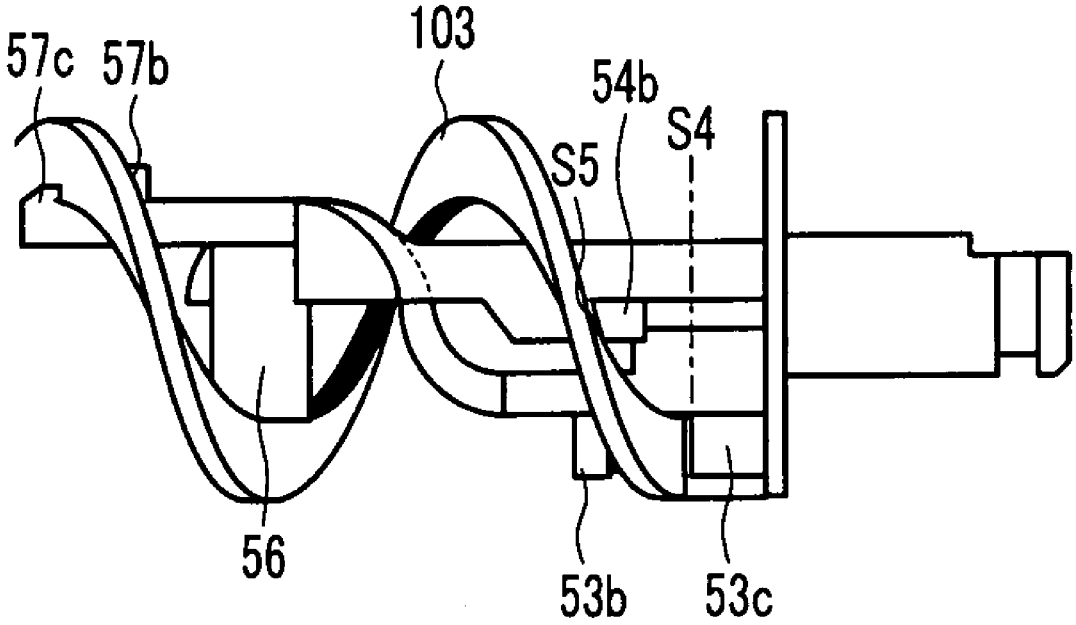
FIG. 14 is a diagram showing how the coil spring is attached to the support element shown in FIG. 9.

FIG. 14 shows how the coil spring 103 is attached to the support element 105 shown in FIG. 9. As shown in the figure, the projection 54*b* is shaped such that it is brought into contact with the disc 52 side (front side) of the coil spring 103. The projection 54*b* has a slant surface S5 that conforms to the helical shape of the coil spring 103. The slant surface S5 is brought into contact with the third side 133*a* in the longitudinal section of the coil spring 103. In this way, the projection 54*b* transmits the rotational force of the motor 120 to the coil spring 103 via the disc 52.

The rod member 54*a* is in contact with the first side 131 in the longitudinal section of the coil spring 103. As described above, the rod member 54*a* is separated from the axis of the cylindrical member 51 (axis of the disc 52) by the distance equal to, or slightly smaller than, half the inner diameter d of the coil spring 103. As such, the axis of the coil spring 103 coincides with the axis of the cylindrical member 51.

The first joint member 58 is a semi-ellipsoidal plate that joins the end inserting member 53, the first support member 54, and the second support member 55 to set their relative positions. As described above, the height of the rod member 54*a* is greater than the height of the end inserting member 53 relative to the disc 52. Thus, the surface of the first joint member 58 is slanted relative to the disc 52. The toner falling onto the slant surface through the toner inlet 106 is transported down along the slant surface, thereby preventing the toner from resting at the toner inlet 106.

The first joint member 58 is semicircular in shape as viewed in the axial direction of the cylindrical member 51, centering on the axis of the cylindrical member 51 and having a diameter equal to or slightly smaller than the inner diameter d of the coil spring 103. The first joint member 58 is not in contact with the first coil spring 103.

The second support member 55 includes a long rod member 55*a* and a projection 55*b*.

The rod member 55*a* is parallel to the axis of the cylindrical member 51 (axis of the disc 52), i.e., perpendicular to the disc 52. The rod member 55*a* is separated from the axis of the cylindrical member 51 by the distance equal to, or slightly smaller than, half the inner diameter d of the coil spring 103. The rod member 55*a* is at an angular position of about 180 degrees relative to the first support member 54, measured in the reverse direction of arrow P shown in FIGS. 8 through 12 about the axis of the cylindrical member 51. One end of the rod member 55*a* is connected to the first joint member 58, and the other end of the rod member 55*a* is connected to the second joint member 59. The height at the highest part of the rod member 55*a* is greater than the height at the highest part of the first support member 54, relative to the surface S2 on the rear side of the disc 52.

The projection 55*b* is formed on the rod member 55*a*, at a position separated from the helix beginning surface S4 by the distance of a ¾ period coil length of the coil spring 103. The projection 55*b* projects out of the rod member 55*a*, away from the axis of the cylindrical member 51. The projection 55*b* is brought into contact with the coil spring 103 at a position ¾ of a coil from the terminus of the coil spring 103, when the portion C of the coil spring 103 is inserted into the end inserting member 53. In this way, the projection 55*b* serves as a position registration member. That is, the projection 55*b* is a support member for the coil spring 103.

Figure 16:
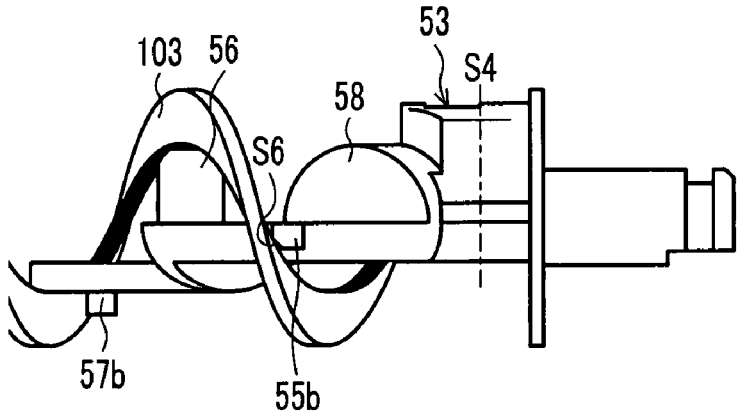
FIG. 16 is a diagram showing how the coil spring is attached to the support element shown in FIG. 11.

FIG. 16 shows how the coil spring 103 is attached to the support element 105 shown in FIG. 11. As shown in the figure, the projection 55*b* is shaped such that it is brought into contact with the disc 52 side (front side) of the coil spring 103. The projection 55*b* has a slant surface S6 that conforms to the helical shape of the coil spring 103. The slant surface S6 is brought into contact with the third side 133*a* in the longitudinal section of the coil spring 103. In this way, the projection 55*b* transmits the rotational force of the motor 120 to the coil spring 103 via the disc 52.

The rod member 55*a* is in contact with the first side 131 in the longitudinal section of the coil spring 103. As described above, the rod member 55*a* is separated from the axis of the cylindrical member 51 (axis of the disc 52) by the distance equal to, or slightly smaller than, half the inner diameter d of the coil spring 103. As such, the axis of the coil spring 103 coincides with the axis of the cylindrical member 51.

The second joint member 59 is a semi-ellipsoidal plate that joins the first support member 54 and the second support member 55 to set their relative positions. As described above, the height at the highest part of the rod member 55*a* is greater than the height at the highest part of the first support member 54 relative to the disc 52. Thus, the surface of the second joint member 59 is slanted relative to the disc 52. The toner falling onto the slant surface through the toner inlet 106 is transported down along the slant surface, thereby preventing the toner from resting at the toner inlet 106.

The second joint member 59 is semicircular in shape as viewed in the axial direction of the cylindrical member 51, centering on the axis of the cylindrical member 51 and having a diameter equal to or slightly smaller than the inner diameter d of the coil spring 103. The second joint member 59 is not in contact with the first coil spring 103.

The fourth support member 56 is a plate-like member that extends parallel to the axis of the cylindrical member 51 (perpendicular to the disc 52). The fourth support member 56 is at an angular position of 90 degrees relative to the second support member 55, measured in the reverse direction of arrow P shown in FIGS. 8 through 12 about the rotational axis of the cylindrical member 51. Further, in the fourth support member 56, the distance between the side farthest from the axis of the cylindrical member 51 (axis of the disc 52) and the axis of the cylindrical member 51 is equal to or slightly smaller than half the inner diameter d of the coil spring 103. The fourth support member 56 is connected to the second joint member 59. Further, the fourth support member 56 is in contact with a portion on the inner periphery surface S4 of the coil spring 103, at a position separated from the helix beginning surface S4 by the distance of a 1 period coil length of the coil spring 103. In this way, the fourth support member 56 serves to prevent position misregistration of the coil spring 103.

In other words, the fourth support member 56 is in contact with the first side 131 in the longitudinal section of the coil spring 103. As described above, in the fourth support member 56, the distance between the side farthest from the axis of the cylindrical member 51 (axis of the disc 52) and the axis of the cylindrical member 51 is equal to or slightly smaller than half the inner diameter d of the coil spring 103. As such, the axis of the coil spring 103 coincides with the axis of the cylindrical member 51.

The third support member 57 includes a long rod member 57*a* and two projections 57*b* and 57*c*.

The rod member 57*a* is parallel to the axis of the cylindrical member 51 (axis of the disc 52), i.e., perpendicular to the disc 52. The rod member 57*a* is separated from the axis of the cylindrical member 51 by the distance equal to, or slightly smaller than, half the inner diameter d of the coil spring 103. The rod member 57*a* is at an angular position of 180 degrees relative to the fourth support member 56, measured in the reverse direction of arrow P shown in FIGS. 8 through 12 about the axis of the cylindrical member 51. One end of the rod member 57*a* is connected to the second joint member 59.

The projections 57*b* and 57*c* are formed on the rod member 57*a*, at a position separated from the helix beginning surface S4 by the distance of about a 1.5 period coil length of the coil spring 103. The projections 57*b* and 57*c* project out of the rod member 57*a*, away from the axis of the cylindrical member 51. The projections 57*b* and 57*c* are brought into contact with the coil spring 103 at a position about ½ coils from the terminus of the coil spring 103, when the terminus of the coil spring 103 is inserted into the end inserting member 53. In this way, the projections 57*b* and 57*c* serve as position registration members. That is, the projections 57*b* and 57*c* are support members for the coil spring 103.

Figure 15:
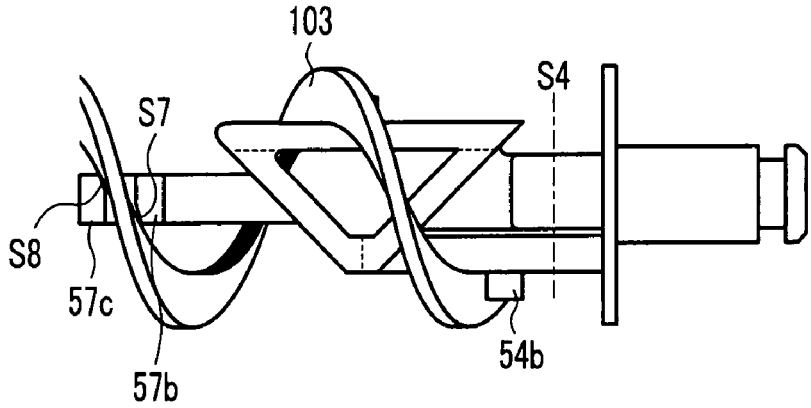
FIG. 15 is a diagram showing how the coil spring is attached to the support element shown in FIG. 10.

FIG. 15 shows how the coil spring 103 is attached to the support element 105 shown in FIG. 10. As shown in the figure, the projection 57*b* is shaped such that it is brought into contact with the disc 52 side (front side) of the coil spring 103. The projection 57*b* has a slant surface S7 that conforms to the helical shape of the coil spring 103. The slant surface S7 is brought into contact with the third side 133*a* in the longitudinal section of the coil spring 103. In this way, the projection 57*b* transmits the rotational force of the motor 120 to the coil spring 103 via the disc 52.

The projection 57*c* is shaped such that it is brought into contact with the coil spring 103 on the opposite side of the disc 52 (rear side). The projection 57*c* has a slant surface S8 that conforms to the helical shape of the coil spring 103. The slant surface S8 is brought into contact with the third side 133*b* in the longitudinal section of the coil spring 103. In this way, the projection 57*c* prevents the first coil spring 103 from stretching and coming off the rod member 57*a*.

The rod member 57*a* is in contact with the first side 131 in the longitudinal section of the coil spring 103. As described above, the rod member 57*a* is separated from the axis of the cylindrical member 51 (axis of the disc 52) by the distance equal to, or slightly smaller than, half the inner diameter d of the coil spring 103. As such, the axis of the coil spring 103 coincides with the axis of the cylindrical member 51.

(Others)

The support element 104 supports the coil spring 102 stored in the second coil spring storing space 109, and transmits the rotational force of the motor to the coil spring 102. The support element 104 has a structure analogous to the structure of the support element 105.

The structure of the support element 104 is not just limited to one described herein, and a conventional structure may be adopted as well.

Figure 17:
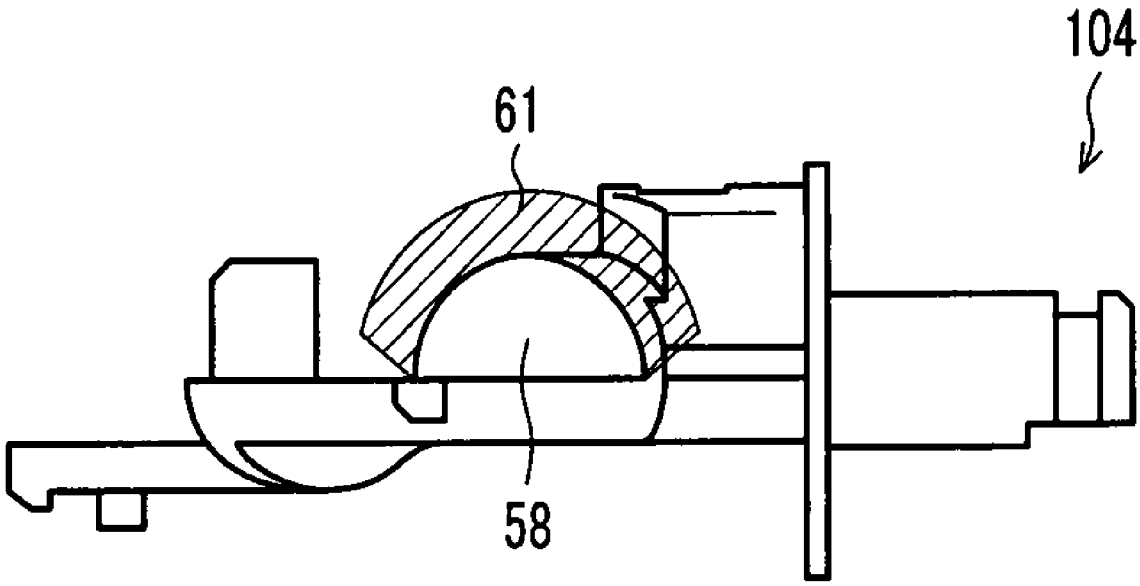
FIG. 17 is a diagram showing a modification example of a support element for supporting a second coil spring.

As shown in FIG. 17, the support element 104 of the coil spring 102 may be provided with a resin film (sliding member) 61 that is brought into contact with wall surfaces of the second coil spring storing space 109 when installed in the toner replenishing device 100, and that wipes toner adhering on the wall surfaces of the coil spring storing space 109. As shown in FIG. 17, the resin film 61 is mounted on the first joint member 58. As described above, the first joint member 58 is not in contact with the second coil spring 102. Thus, the resin film 61 does not interfere with the coil spring 102. The resin film 61 may be mounted on the second joint member 59.

The resin film 61 may be a PET (polyethylene terephthalate) film or a PTFE (polytetrafluoroethylene) film, for example.

By the rotation of the support element 104, the resin film 61 slides on wall surfaces in the vicinity of the toner outlet 107 in the coil spring storing space 109. This prevents toner from resting in this area of the coil spring storing space 109 and thereby allows the toner to be efficiently ejected out of the toner outlet 107. Note that, instead of the resin film 61, a rubber plate may be used. However, the film is more preferable because the frictional force of the rubber against the wall surface is strong.

The resin film 61 can be described as an agitator that wipes toner adhering on the wall surfaces. The shape of the resin film 61 is not just limited to one shown in FIG. 17.

As described above, the support element 105 supports the coil spring 103 that rotates to transport toner. The support element 105 also transmits the rotational force of the motor (driving means) 120 to the coil spring 103. The support element 105 includes the end inserting member 53 with a recess where the portion C (see FIG. 6(*a*)) provided at an end of the coil spring 103 is inserted; a plurality of support members 54, 55, 56, and 57 for supporting the coil spring 103 at portions other than the end portion; and joint members 58 and 59 that join the end inserting member 53 and the support members 54, 55, 56, and 57.

For example, the support members include: the first support member 54 that supports the coil spring 103 at a position ¼ of a coil from the end portion of the coil spring 103; the second support member 55 that supports the coil spring 103 at a position ½ of a coil from the end portion of the coil spring 103; and the third support member 57 that supports the coil spring 103 at a position 3/2 coils from the end portion of the coil spring 103.

The joint members 58 and 59 join the end inserting member 53 and the support members 54, 55, 56, and 57 to set their relative positions. The joint members 58 and 59 are only required to join the end inserting member 53 and the support members 54, 55, 56, and 57. As such, the joint members 58 and 59 are structured to solely serve this purpose.

The foregoing construction creates a free space inside the coil spring where toner can enter. This was not possible with a conventional structure in which a rotational axis member occupied inside the coil spring. With the forgoing construction, the support element 105 does not block a toner flow, even though the toner inlet 106 is formed above the support element 105. This increases the toner flow rate as compared with the conventional structure.

Further, since the support element 105 supports the coil spring 103 at more than one position including an end portion, the rotational force of the driving means such as the motor 120 can be efficiently transmitted to the coil spring 103.

The support element 105 is in contact with the coil spring 103 to set the axis of the coil spring 103 in position. In this way, the support element 105 serves as a position registration member for the coil spring 103. As described above, since merely an end of the coil spring 103 is inserted into the end inserting member 53, the support element 105 can be easily attached/detached to and from the coil spring 103.

The longitudinal section of the coil spring 103 is a rectangle composed of the first side 131, the second side 132, and the third sides 133*a* and 133*b*. The first side 131 is parallel to the axis of the coil spring 103 and is situated on the inner side of the coil spring 103. The second side 132 is parallel to the axis of the coil spring 103 and is situated on the outer side of the coil spring 103. The third sides 133*a* and 133*b* are perpendicular to the axis of the coil spring 103. The first support member 54, the second support member 55, and the third support member 57 are in contact with the first side 131 and the third side 133*a* of the coil spring 103.

According to this construction, the first support member 54, the second support member 55, and the third support member 57 are in contact with the first side 131 of the coil spring 103. This prevents the axis of the coil spring 103 from shifting out of position. Further, because the first support member 54, the second support member 55, and the third support member 57 are in contact with the third side 133*a* perpendicular to the axis of the coil spring 103, the rotational force of the motor 120 can be efficiently transmitted to the coil spring 103.

That is, the first support member 54, the second support member 55, and the third support member 57 serve to transmit the rotational force of the motor 120 to the coil spring 103. In this way, the rotational force of the motor 120 will not concentrate on one point on the coil spring 103. This prevents fatigue caused by such localized concentration of the rotational force. The rotational force of the motor 120 can be efficiently transmitted to the coil spring 103 as well.

The toner replenishing device 100 of the present embodiment includes the toner inlet 106 through which toner is supplied from the toner bottle 200 containing toner, and the toner outlet 107 through which toner is ejected out of the developing unit 2, wherein toner is transported from the toner inlet 106 to the toner outlet 107 be being agitated. The toner replenishing device 100 also includes: the support element 105 provided beneath the toner inlet 106; the motor (driving means) 120 for rotating the support element 105; and the coil spring 103, supported by the support element 105, which transports the supplied toner from the toner inlet 106 to the toner outlet 107 by undergoing rotation under the rotational force transmitted from the motor 120 via the support element 105.

According to the foregoing structure, the support element 105 provided beneath the toner inlet 106 supports the coil spring 103 at more than one position, and, unlike conventional structures, does not occupy the space inside the coil spring. With this construction, the support element 105 does not block the toner supplied through the toner inlet 106. This increases the flow rate of toner supplied through the toner inlet 106.

The toner replenishing device 100 further includes: the second coil spring 102 provided side by side with the first coil spring 103, with their axis facing each other in parallel; and the partition (parting member) 108, provided between the first coil spring 103 and the second coil spring 102, for parting the first coil spring storing space (first space) 110 storing the first coil spring 103 from the second coil spring storing space (second space) 109 storing the second coil spring 102.

The first coil spring 103 and the second coil spring 102 rotate to transport toner in opposite directions, in a direction of arrow G in the first coil spring 103 as shown in FIG. 4, and in a direction of arrow H in the second coil spring 102 as shown in FIG. 4. The toner inlet 106 is provided in the upper surface of the first coil spring storing space 110 at an upstream end (front end) in the toner transport direction. The toner outlet 107 is provided in the bottom surface of the second coil spring storing space 109 at a downstream end (front end) in the toner transport direction.

The partition 108 includes (a) the first bypass portion 111 through which a downstream end in the toner transport direction in the first coil spring storing space 110 is in communication with the upstream end in the toner transport direction in the second coil spring storing space 109, and (b) the second bypass portion 112, provided between the first bypass portion 111 and the toner openings (the toner inlet 106, the toner outlet 107), through which the first coil spring storing space 110 and the second coil spring storing space 109 are in communication with each other.

In the first coil spring storing space 110, the toner supplied through the toner inlet 106 is transported by the rotation of the first coil spring 103, from the upstream end to downstream end in the toner transport direction. The toner in the first coil spring storing space 110 enters the second coil spring storing space 109 through the first bypass portion 111 or the second bypass portion 112. The toner that has entered the second coil spring storing space 109 is transported therein by the rotation of the second coil spring 102, from the upstream end to downstream end in the toner transport direction, and is ejected from the toner outlet 107 to the developing unit 2 via the eject pipe 300.

The transport path through the second bypass portion 112 is route A, and the transport path through the first bypass portion 111 is route B. The first bypass portion 111 connects the downstream end of the toner transport direction in the first space and the upstream end of the toner transport direction in the second space. Thus, route B has a sufficiently long distance from the toner inlet 106 to the toner outlet 107, allowing the toner to be sufficiently agitated.

The second bypass portion 112 is provided between the first bypass portion 111 and the toner openings (toner inlet 106, toner outlet 107). Thus, route A has a shorter distance between the toner inlet 106 and the toner outlet 107 as compared with route B. This allows the toner to be quickly ejected. The toner traveling route A meets the sufficiently agitated toner that has traveled in route B. Since these toners are mixed together, the problems of toner aggregation, charge, and uniformity do not occur.

By providing two bypass portions, a quick supply of toner is possible while ensuring good toner agitation.

The toner replenishing device 100 also includes glass beads (anti-abrasive) in a bottom surface that is brought into contact with the coil springs 102 and 103. The bottom surface in contact with the coil springs 102 and 103 is easily subjected to the frictional force as exerted by the force of gravity acting on the coil springs 102 and 103. By providing glass beads in the bottom surface, there will be no damage to the toner replenishing device 100.

The toner replenishing device 100 also includes the support member (rotation member) 104, attached to the second coil spring 102 at the downstream end of the toner transport direction, that supports the second coil spring 102 and transmits the rotational force to the coil spring 102.

The support element 104 is provided with the resin film (sliding member) 61 that, by the rotation of the support element 104, slides on the wall surfaces defining the second coil spring storing space 109.

The toner outlet 107 is provided in the bottom surface at the downstream end of the toner transport direction in the second coil spring 102. Thus, the resin film 61 slides on wall surfaces, in the vicinity of the toner outlet 107, that define the second coil spring storing spaces 109. This prevents the toner from resting in areas in the vicinity of the toner outlet 107, and thereby ensures a sufficient toner flow rate.

A toner supply apparatus of the present embodiment includes: the toner replenishing device 100; the toner bottle 200, provided on the toner replenishing device 100, for supplying toner to the toner replenishing device 100 via the toner inlet 106; the eject pipe 300 in communication with the toner outlet 107 of the toner replenishing device 100; and the developing unit 2, installed beneath the eject pipe 300, which receives the toner supplied from the toner replenishing device 100 through the eject pipe 300.

An image forming apparatus A of the present embodiment is of an intermediate transfer type that includes: the toner supply apparatus, a plurality of image forming units, respectively corresponding to toners of different colors, each including a photoreceptor and the toner supply apparatus; and the intermediate transfer belt (intermediate transfer body) 7, wherein toner images respectively formed on the photoreceptors of the image forming units are transferred onto the intermediate transfer belt 7, and the toner images on the intermediate transfer belt 7 are transferred onto a printing medium.

With this construction, a smooth flow of toner into the toner replenishing device 100 can be ensured even when size restrictions on the layout and structure of the image forming apparatus A necessitates the support element 105 to be placed directly below the toner inlet 106.

The embodiment(s) present invention are applicable to an image forming apparatus, for example, such as a copying machine or a printer, in which toner is supplied via a toner transport device to a developing unit that is disposed beneath a toner replenishing device such as a toner cartridge.

As described above, one or more embodiments of the present invention provides a support element for supporting a coil spring that rotates to transport toner, and transmitting a rotational force of driving means to the coil spring, the support element including: an end inserting member with a recess in which an end portion of the coil spring is inserted; a plurality of support members for supporting non-end portions of the coil spring; and a joint member for joining the end inserting member and the support members.

According to this structure, the support element supports an end portion and non-end portions of the coil spring.

For example, the support members include: a first support member for supporting the coil spring at a position ¼ of a coil from the end portion of the coil spring; a second support member for supporting the coil spring at a position ½ of a coil from the end portion of the coil spring; and a third support member for supporting the coil spring at a position 3/2 coils from the end portion of the coil spring.

The joint member joins the end inserting member and the support members. This sets relative positions of the end inserting member and the support members.

The joint member is only required to join the end inserting member and the support members. As such, the joint members are structured to solely serve this purpose.

The foregoing construction creates a free space inside the coil spring where toner can enter. This was not possible with a conventional structure in which a rotational axis member occupied inside the coil spring. With the forgoing construction, the support element does not block a toner flow, even though the toner inlet is formed above the support element. This increases the toner flow rate as compared with the conventional structure.

Further, since the support element supports the coil spring at more than one position including an end portion, the rotational force of the driving means such as a motor can be efficiently transmitted to the coil spring.

It is preferable in a support element that the support members be in contact with the coil spring so as to set an axis of the coil spring in position.

Since merely an end of the coil spring is inserted into the end inserting member, the support element can be easily attached/detached to and from the coil spring.

In an embodiment of the support element, it is preferable that the coil spring has a longitudinal section that is rectangular in shape with (i) a first side parallel to an axis of the coil spring and situated on an inner side of the coil spring, (ii) a second side parallel to the axis of the coil spring and situated on an outer side of the coil spring, and (iii) third sides perpendicular to the axis of the coil spring, and that the support members are in contact with the first side and one of or both of the third sides.

According to this structure, the support members are in contact with the first side of the coil spring. This prevents the axis of the coil spring from shifting out of position. Further, because the support members are in contact with the third side perpendicular to the axis of the coil spring, the rotational force of the motor can be efficiently transmitted to the coil spring.

Further, the support members serve to transmit the rotational force of the motor to the coil spring. In this way, the rotational force of the motor will not concentrate on one point on the coil spring. This prevents fatigue caused by such localized concentration of the rotational force. The rotational force of the motor can be efficiently transmitted to the coil spring as well.

The embodiment(s) present invention provide a toner replenishing device including a toner inlet through which toner stored in a toner bottle is supplied, and a toner outlet through which toner is ejected to a developing unit, the toner being transported from the toner inlet to the toner outlet by being agitated, the toner replenishing device including: the support element disposed below the toner inlet; driving means for driving the support element to rotate; and a first coil spring, supported by the support element, for transporting the supplied toner from the toner inlet toward the toner outlet by undergoing rotation under the rotational force transmitted by the support element from the driving means.

According to the foregoing structure, the support element provided beneath the toner inlet supports the coil spring at more than one position, and, unlike conventional structures, does not occupy the space inside the coil spring. With this construction, the support element does not block the toner supplied through the toner inlet. This increases the flow rate of toner supplied through the toner inlet.

It is preferable that the toner replenishing device further include: a second coil spring, disposed side by side with the first coil spring so that an axis of the second coil spring faces an axis of the first coil spring; and a partition, disposed between the first coil spring and the second coil spring, for parting a first space in which the first coil spring is stored, and a second space in which the second coil spring is stored, the first coil spring and the second coil spring rotating to transport toner in opposite directions, the toner inlet being provided in an upper surface at an upstream end of the toner transport direction in the first space, and the toner outlet being provided in a bottom surface at a downstream end of the toner transport direction in the second space, the partition including (a) a first bypass portion through which the downstream end of the toner transport direction in the first space is in communication with the upstream end of the toner transport direction in the second space, and (b) a second bypass portion, provided between the first bypass portion and the toner inlet and outlet, through which the first space and the second space are in communication with each other.

In the first coil spring storing space, the toner supplied through the toner inlet is transported by the rotation of the first coil spring, from the upstream end to downstream end in the toner transport direction. The toner in the first coil spring storing space enters the second coil spring storing space through the first bypass portion or the second bypass portion. The toner that has entered the second coil spring storing space is transported therein by the rotation of the second coil spring, from the upstream end to downstream end in the toner transport direction, and is ejected from the toner outlet to the developing unit via the eject pipe.

The transport path through the second bypass portion is route A, and the transport path through the first bypass portion is route B. The first bypass portion connects the downstream end of the toner transport direction in the first space and the upstream end of the toner transport direction in the second space. Thus, route B has a sufficiently long distance from the toner inlet to the toner outlet, allowing the toner to be sufficiently agitated.

The second bypass portion is provided between the first bypass portion and the toner inlet and outlet. Thus, route A has a shorter distance between the toner inlet and the toner outlet as compared with route B. This allows the toner to be quickly ejected. The toner traveling route A meets the sufficiently agitated toner that has traveled in route B. Since these toners are mixed together, the problems of toner aggregation, charge, and uniformity do not occur.

By providing two bypass portions, a quick supply of toner is possible while ensuring good toner agitation.

It is preferable that a toner replenishing device of the present invention include an anti-abrasive in a bottom surface that is in contact with the first coil spring and the second coil spring.

The anti-abrasive is realized by glass beads, for example. The bottom surface in contact with the coil spring is easily subjected to the frictional force as exerted by the force of gravity acting on the coil spring. By providing glass beads in the bottom surface, there will be no damage to the toner replenishing device.

It is preferable that a toner replenishing device of the present invention include a rotating member, provided on the second coil spring at the downstream end of the toner transport direction, for supporting the second coil spring and transmitting the rotational force to the second coil spring, wherein the rotating member includes a sliding member that slides on a wall surface of the second space as the rotating member rotates.

The toner outlet is provided in the bottom surface at the downstream end of the toner transport direction in the second coil spring. Thus, the sliding member slides on wall surfaces, in the vicinity of the toner outlet, that define the second coil spring storing space. This prevents the toner from resting in areas in the vicinity of the toner outlet, and thereby ensures a sufficient toner flow rate.

The embodiment(s) present invention provide a toner supply apparatus including: the toner replenishing device; a toner bottle, mounted on the toner replenishing device, for supplying toner to the toner replenishing device through the toner inlet; an eject pipe in communication with the toner outlet of the toner replenishing device; and a developing unit, mounted beneath the eject pipe, to which the toner is supplied from the toner replenishing device through the eject pipe.

The embodiment(s) present invention provide an image forming apparatus including: a plurality of image forming units, respectively corresponding to toners of different colors, each including a photoreceptor and the toner supply apparatus; and an intermediate transfer belt to which toner images respectively formed on the photoreceptors of the image forming units are transferred, wherein the image forming apparatus operates according to an intermediate transfer scheme to transfer the toner images formed on the intermediate transfer belt onto a printing medium.

With this structure, a smooth flow of toner into the toner replenishing device can be ensured even when size restrictions on the layout and structure of the image forming apparatus necessitates the support element to be placed directly below the toner inlet.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A support element for supporting a coil spring that rotates to transport toner, comprising:

an end inserting member with a recess in which an end portion of the coil spring is inserted;

a plurality of support members for supporting non-end portions of the coil spring; and a joint member for joining the end inserting member and the support members, wherein the support element is arranged to transmit a rotational force from driving means to the coil spring, wherein the coil spring has a longitudinal section that is rectangular in shape with (i) a first side parallel to an axis of the coil spring and situated on an inner side of the coil spring, (ii) a second side parallel to the axis of the coil spring and situated on an outer side of the coil spring, and (iii) third sides perpendicular to the axis of the coil spring, and wherein the support members are in contact with the first side and one of or both of the third sides.

2. The support element as set forth in claim 1, wherein the support members are in contact with the coil spring so as to set an axis of the coil spring in position.

3. The support element as set forth in claim 1, wherein the support members transmit the rotational force of the driving means to the coil spring.

4. The support element as set forth in claim 1, wherein the support members include: a first support member for supporting the coil spring at a position ¼ of a coil from the end portion of the coil spring; a second support member for supporting the coil spring at a position ½ of a coil from the end portion of the coil spring; and a third support member for supporting the coil spring at a position 3/2 coils from the end portion of the coil spring.

5. The support element as set forth in claim 1, wherein the joint member and the plurality of support members are arranged so as to form an opening therein such that the support element does not occupy at least a portion of an inner space of the coil spring.

6. The support element as set forth in claim 1, wherein the end inserting member, the plurality of support members, and the joint member are integrally formed as a single unit.

7. The support element as set forth in claim 1, wherein the plurality of support members are in contact with different non-end portions of the coil spring.

8. A toner replenishing device including a toner inlet through which toner stored in a toner bottle is supplied, and a toner outlet through which toner is ejected to a developing unit, the toner being transported from the toner inlet to the toner outlet by being agitated, said toner replenishing device comprising:

a support element disposed below the toner inlet;

driving means for driving the support element to rotate; and a first coil spring, supported by the support element, for transporting the supplied toner from the toner inlet toward the toner outlet by undergoing rotation under the rotational force transmitted by the support element from the driving means, the support element including:

an end inserting member with a recess in which an end portion of the first coil spring is inserted;

a plurality of support members for supporting non-end portions of the first coil spring; and a joint member for joining the end inserting member and the support members.

9. The toner replenishing device as set forth in claim 8, further comprising:

a second coil spring, disposed side by side with the first coil spring so that an axis of the second coil spring faces an axis of the first coil spring; and a partition, disposed between the first coil spring and the second coil spring, for parting a first space in which the first coil spring is stored, and a second space in which the second coil spring is stored, the first coil spring and the second coil spring rotating to transport toner in opposite directions, the toner inlet being provided in an upper surface at an upstream end of the toner transport direction in the first space, and the toner outlet being provided in a bottom surface at a downstream end of the toner transport direction in the second space, the partition including (a) a first bypass portion through which the downstream end of the toner transport direction in the first space is in communication with the upstream end of the toner transport direction in the second space, and (b) a second bypass portion, provided between the first bypass portion and the toner inlet and outlet, through which the first space and the second space are in communication with each other.

10. The toner replenishing device as set forth in claim 9, comprising a rotating member, provided on the second coil spring at the downstream end of the toner transport direction, for supporting the second coil spring and transmitting the rotational force to the second coil spring, wherein the rotating member includes a sliding member that slides on a wall surface of the second space as the rotating member rotates.

11. The toner replenishing device as set forth in claim 9, wherein the support element is a first support element, the toner replenishing device further comprising:

a second support element arranged to support the second coil spring, the second support element comprising:

a second end inserting member with a recess in which an end portion of the second coil spring is inserted;

a plurality of second support members for supporting non-end portions of the second coil spring; and a second joint member for joining the second end inserting member and the plurality of second support members, wherein the second joint member and the plurality of second support members are arranged so as to form a second opening therein, and wherein the second opening is located above the toner outlet so as to coincide in a vertical direction.

12. The toner replenishing device as set forth in claim 11, wherein the second support element further comprises a toner wiper arranged to wipe toner adhering to wall surfaces of the second space to eject the toner out of the toner outlet.

13. The toner replenishing device as set forth in claim 8, comprising an anti-abrasive in a bottom surface that is in contact with the first coil spring.

14. The toner replenishing device as set forth in claim 8, wherein the joint member and the plurality of support members are arranged so as to form an opening therein such that the support element does not occupy at least a portion of an inner space of the first coil spring.

15. The toner replenishing device as set forth in claim 8, wherein the opening of the support element is located below the toner inlet so as to coincide in a vertical direction.

16. The toner replenishing device as set forth in claim 8, further comprising a cabinet arranged to house the first coil spring such that there is a predetermined clearance between a downstream end portion of the first coil spring and an inner rear wall of the cabinet.

17. The toner replenishing device as set forth in claim 8, wherein the end inserting member, the plurality of support members, and the joint member are integrally formed as a single unit.

18. The toner replenishing device as set forth in claim 8, wherein the plurality of support members are in contact with different non-end portions of the coil spring.

19. A toner supply apparatus, comprising:

a toner replenishing device including a toner inlet through which toner is supplied, and a toner outlet through which toner is ejected, the toner being transported from the toner inlet to the toner outlet by being agitated;

a toner bottle, mounted on the toner replenishing device, for supplying toner to the toner replenishing device through the toner inlet;

an eject pipe in communication with the toner outlet of the toner replenishing device; and a developing unit, mounted beneath the eject pipe, to which the toner is supplied from the toner replenishing device through the eject pipe, said toner replenishing device including:

a support element disposed below the toner inlet;

driving means for driving the support element to rotate; and a first coil spring, supported by the support element, for transporting the supplied toner from the toner inlet toward the toner outlet by undergoing rotation under the rotational force transmitted by the support element from the driving means, the support element including:

an end inserting member with a recess in which an end portion of the first coil spring is inserted;

a plurality of support members for supporting nontnd portions of the first coil spring; and a joint member for joining the end inserting member and the support members.

20. The toner supply apparatus as set forth in claim 19, wherein the joint member and the plurality of support members are arranged so as to form an opening therein such that the support element does not occupy at least a portion of an inner space of the first coil spring.

21. The toner supply apparatus as set forth in claim 20, wherein the opening of the support element is located below the toner inlet so as to coincide in a vertical direction.

22. The toner supply apparatus as set forth in claim 19, wherein the support element is a first support element, wherein the toner replenishing device further comprises:

a second support element arranged to support the second coil spring, the second support element comprising:

a second end inserting member with a recess in which an end portion of the second coil spring is inserted;

a plurality of second support members for supporting non-end portions of the second coil spring; and a second joint member for joining the second end inserting member and the plurality of second support members, wherein the second joint member and the plurality of second support members are arranged so as to form a second opening therein, and wherein the second opening is located above the toner outlet so as to coincide in a vertical direction.

23. The toner supply apparatus as set forth in claim 22, wherein the second support element further comprises a toner wiper arranged to wipe toner adhering to wall surfaces of a space within which the second coil spring is stored to eject the toner out of the toner outlet.

24. The toner supply apparatus as set forth in claim 19, wherein the toner replenishing device further comprises a cabinet arranged to house the first coil spring such that there is a predetermined clearance between a downstream end portion of the first coil spring and an inner rear wall of the cabinet.

25. The toner supply apparatus as set forth in claim 19, wherein the end inserting member, the plurality of support members, and the joint member are integrally formed as a single unit.

26. The toner supply apparatus as set for the in claim 19, wherein the plurality of support members are in contact with different non-end portions of the coil spring.

27. An image forming apparatus comprising a toner supply apparatus that includes:

a toner replenishing device including a toner inlet through which toner is supplied, and a toner outlet through which toner is ejected, the toner being transported from the toner inlet to the toner outlet by being agitated;

a toner bottle, mounted on the toner replenishing device, for supplying toner to the toner replenishing device through the toner inlet;

an eject pipe in communication with the toner outlet of the toner replenishing device; and a developing unit, mounted beneath the eject pipe, to which the toner is supplied from the toner replenishing device through the eject pipe, said toner replenishing device including:

a support element disposed below the toner inlet;

driving means for driving the support element to rotate; and a first coil spring, supported by the support element, for transporting the supplied toner from the toner inlet toward the toner outlet by undergoing rotation under the rotational force transmitted by the support element from the driving means, the support element including:

an end inserting member with a recess in which an end portion of the first coil spring is inserted;

a plurality of support members for supporting non-end portions of the first coil spring; and a joint member for joining the end inserting member and the support members.

28. An image forming apparatus as set forth in claim 27, further comprising:

a plurality of image forming units, respectively corresponding to toners of different colors, each including a photoreceptor and the toner supply apparatus; and an intermediate transfer belt to which toner images respectively formed on the photoreceptors of the image forming units are transferred, wherein the image forming apparatus operates according to an intermediate transfer scheme to transfer the toner images formed on the intermediate transfer belt onto a printing medium.

29. The image forming apparatus as set forth in claim 27, wherein the joint member and the plurality of support members are arranged so as to form an opening therein such that the support element does not occupy at least a portion of an inner space of the first coil spring.

30. The image forming apparatus as set forth in claim 29, wherein the opening of the support element is located below the toner inlet so as to coincide in a vertical direction.

31. The image forming apparatus as set forth in claim 27, wherein the support element is a first support element, wherein the toner replenishing device further comprises:

a second support element arranged to support the second coil spring, the second support element comprising:

a second end inserting member with a recess in which an end portion of the second coil spring is inserted;

a plurality of second support members for supporting non-end portions of the second coil spring; and a second joint member for joining the second end inserting member and the plurality of second support members, wherein the second joint member and the plurality of second support members are arranged so as to form a second opening therein, and wherein the second opening is located above the toner outlet so as to coincide in a vertical direction.

32. The image forming apparatus as set forth in claim 31, wherein the second support element further comprises a toner wiper arranged to wipe toner adhering to wall surfaces of a space within which the second coil spring is stored to eject the toner out of the toner outlet.

33. The image forming apparatus as set forth in claim 27, wherein the toner replenishing device further comprises a cabinet arranged to house the first coil spring such that there is a predetermined clearance between a downstream end portion of the first coil spring and an inner rear wall of the cabinet.

34. The image forming apparatus as set forth in claim 27, wherein the end inserting member, the plurality of support members, and the joint member are integrally formed as a single unit.

35. The image forming apparatus as set forth in claim 27, wherein the plurality of support members are in contact with different non-end portions of the coil spring.

* * * * *